US007580647B2

(12) United States Patent
Komiya

(10) Patent No.: US 7,580,647 B2
(45) Date of Patent: Aug. 25, 2009

(54) IMAGE FORMING APPARATUS AND CONTROL METHOD FOR IMAGE FORMING APPARATUS

(75) Inventor: Yoshiyuki Komiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 550 days.

(21) Appl. No.: 11/459,195

(22) Filed: Jul. 21, 2006

(65) Prior Publication Data

US 2007/0019975 A1 Jan. 25, 2007

(30) Foreign Application Priority Data

Jul. 22, 2005 (JP) ..... 2005-213376

(51) Int. Cl.
*G03G 15/00* (2006.01)

(52) U.S. Cl. ..... 399/49; 399/72; 399/86

(58) Field of Classification Search ..... 399/49, 399/72, 82, 86

See application file for complete search history.

(56) References Cited

U.S. PATENT DOCUMENTS

2002/0118976 A1* 8/2002 Fischer ..... 399/49

FOREIGN PATENT DOCUMENTS

| | | |
|---|---|---|
| JP | 10-240082 A | 9/1998 |
| JP | 2001-75318 A | 3/2001 |
| JP | 2002-44309 A | 2/2002 |

* cited by examiner

*Primary Examiner*—David M Gray
*Assistant Examiner*—Bryan P Ready
(74) *Attorney, Agent, or Firm*—Rossi, Kimms & McDowell LLP

(57) ABSTRACT

An image forming apparatus including an image forming device which forms images on an image carrier and forms the images in a plurality of image formation regions on an intermediate transfer body controls image adjustment and image formation execution in the plurality of image formation regions on the intermediate transfer body (S710, S711).

4 Claims, 32 Drawing Sheets

IMAGE FORMING APPARATUS AND CONTROL METHOD FOR IMAGE FORMING APPARATUS

BACKGROUND OF THE INVENTION

1. Field of the Invention

The present invention relates to an image forming apparatus which transfers toner images of respective color components onto a printing medium to obtain an image using an electrophotographic method or electrostatic printing method, and a control method for the image forming apparatus.

2. Description of the Related Art

Conventionally, an apparatus shown in FIG. 25 is used as a color image forming apparatus. A developing means comprises a magenta toner developing unit 3M, cyan toner developing unit 3C, yellow toner developing unit 3Y, and black toner developing unit 3K. A rotary developing unit 3 is supported to be rotatable by a rotation support device (not shown). The above-described color toner developing units develop the images using corresponding color toners while opposing a photosensitive drum 4 in turn.

With this structure of developing means, the photosensitive drum 4 is rotationally driven at a predetermined angular velocity, so the surface of the photosensitive drum 4 is uniformly charged by a charger 8. ON/OFF of a laser beam is controlled in correspondence with image data of the first color (e.g., magenta) to form an electrostatic latent image of the first color on the photosensitive drum 4. The obtained image is developed and visualized by the magenta toner developing unit 3M of the first color. While this visualized first toner image is brought into press contact with the photosensitive drum 4 with a predetermined force, it is transferred onto a printing medium 6 held on the surface of a rotationally driven transfer drum 5. The above-described transfer process is similarly repeated for the other toners (yellow, cyan, and black). Every time this process is repeated, toner images formed with respective color toners contained in the corresponding developing units are in turn transferred and superimposed on the printing medium 6 carried on the transfer drum 5, thus forming a color image. The printing medium 6 is fixed by a fixing unit 7 and discharged outside from the image forming apparatus.

At this time, the above-described color image forming apparatus cannot obtain a full-color image until the transfer drum 5 rotates several times. Therefore, a full-color image is formed at a slower speed than in a monochrome image which can be obtained by rotating a transfer drum once.

To solve this problem, it is common practice to transfer a plurality of images onto a transfer drum at once so as to simultaneously obtain a plurality of full-color images by driving the transfer drum in one sequence, thus speeding up full-color image formation. For example, as shown in FIG. 26, two printing media 6A and 6B are simultaneously carried at corresponding reference positions PA and PB of the peripheral surface of the transfer drum 5 (to be referred to as two-page printing hereinafter). Therefore, the transfer drum 5 can simultaneously transfer two full-color images onto the two printing media 6A and 6B per rotation.

In recent years, it is necessary to increase the speed of a monochrome output so as to cope with the demands of office use.

Under these circumstances, the wait time (warm-up time) from when the image forming apparatus returns to a normal power supply mode (to be referred to as activation hereinafter) after power ON or from a low-power mode until the output actually becomes ready (standby) causes the users great inconvenience. Temperature control and image adjustment of a fixing unit occupy most of the activation time after power ON.

Conventionally, temperature control of a fixing unit is very important. High-temperature stable temperature control is therefore demanded to develop colors and fix toners by melting the toners and mixing the colors. In particular, assume that the power supply is turned on while the fixing unit has a low temperature upon having been left unused. Upon such activation, problems for minimizing the time required to raise the temperature of a fixing roller and for controlling the temperature of the entire region of the fixing roller without any variation exist. As a measure against this problem, there has conventionally been proposed a technique for using a fixing roller made of a high-thermal-conductivity material, or a technique for forming a thin surface layer of a fixing roller. Another approach uses toner which can readily melt without any variation even at a low temperature.

Furthermore, along with a recent increase in full-color output, assurance of the density stability and tone stability of an output image is being demanded. To meet this demand, the following techniques have been known as image control methods for an image forming apparatus.

Japanese Patent Laid-Open No. 2001-75318 discloses the following technique. An image forming apparatus is activated and performs a warm-up operation. After completion of that operation, the apparatus forms a solid image pattern and halftone image pattern, and reads the densities of these patterns. On the basis of the read density values, the apparatus executes maximum density control and tone control which change the operation of a circuit such as a γ correction circuit which determines the image formation condition, thus stabilizing the quality of an image to be formed.

Japanese Patent Laid-Open No. 10-240082 discloses the following technique. Even when the tone characteristic of a specific pattern changes upon a variation in environmental conditions, an image forming apparatus forms and reads that pattern again. The apparatus feeds back the result again to a circuit such as a γ correction circuit which determines the image formation condition, thus stabilizing the image quality in accordance with the variation amount of that environmental condition.

In Japanese Patent Laid-Open No. 10-240082, when the image forming apparatus is used over a long period of time, the density obtained by reading the pattern on an image carrier may not coincide with the density of an image actually printed out. To solve this problem, there has further been known a technique for forming a specific pattern on a printing medium to correct the image formation condition depending on its density value. There has still further been known the following technique. An image forming apparatus forms a specific pattern in a non-image region during an image formation operation and reads the density of that pattern. On the basis of the read density value, the apparatus changes the operation of a circuit such as a γ correction circuit which determines the image formation condition for every image formation operation, thus accurately correcting the image characteristic which varies every moment.

However, in a recent color image forming apparatus, the user who wants to output a monochrome image or the user who wants to output a business document with little concern for tonality immediately after activation must wait for a standby state until the image adjustment is finished. Therefore, activation as fast possible is demanded.

To meet this demand, in Japanese Patent Laid-Open No. 2002-44309, an image forming apparatus recognizes at the time of activation whether the job of interest is a monochrome job or color job. The apparatus omits image adjustment if that job is a monochrome job, and executes image adjustment if that job is a color job. Japanese Patent Laid-Open No. 2002-44309 can assure the density and tone for a color job after activation. However, the activation time for a color job remains the same as that in the prior arts.

That is, a color image forming apparatus controls the temperature of a fixing unit and executes an image adjustment operation after completion of a warm-up operation, so the wait time does not shorten. To shorten the wait time, when both the operations are simultaneously executed, a large amount of power is required. This measure falls behind recent moves for energy savings.

SUMMARY OF THE INVENTION

The present invention has been proposed to solve the conventional problems, and has as its object to perform an image formation operation while executing image adjustment upon omitting image adjustment after completion of a warm-up operation at the time of activation, and selecting an image adjustment mode in the subsequent process in accordance with the presence/absence of a reserved job and whether the reserved job is a monochrome print job or color print job. In particular, it is an object of the present invention to provide an image forming apparatus and control method which can shorten the wait time and output an adjusted image by setting, when the reserved job is a color print job, a color mode which enables two-page printing. The above-described reserved job includes an input image formation mode.

In order to achieve the above object, an image forming apparatus and a control method for the image forming apparatus according to the present invention are mainly characterized by comprising the following arrangements.

According to the present invention, the foregoing object is attained by providing an image forming apparatus comprising: an image forming device which forms images on an image carrier, forms the images on an intermediate transfer body including a first region and second region as regions to form the images, and forms the images of a plurality of colors on a printing medium; and a controller which controls the image forming device to execute an image adjustment operation for adjusting an image formation condition of the image forming device in the first region of the intermediate transfer body and to execute an operation for forming the image in the second region of the intermediate transfer body.

According to the present invention, the foregoing object is also attained by providing an image forming apparatus comprising: an image forming device which forms images on an image carrier, forms the images on an intermediate transfer body including a first region and second region as regions to form the images, and forms the images of a plurality of colors on a printing medium; and a controller which, when an input image formation mode is found to be a color image formation mode by determining whether the input image formation mode is the color image formation mode, controls the image forming device to execute an image adjustment operation for adjusting an image formation condition of the image forming device in the first region of the intermediate transfer body and to execute an operation for forming the image in the second region of the intermediate transfer body.

According to the present invention, the foregoing object is also attained by providing an image forming method executed by an image forming apparatus, the method comprising: a step of image forming executed by an image forming device which forms images on an image carrier, forms the images on an intermediate transfer body including a first region and second region as regions to form the images, and forms the images of a plurality of colors on a printing medium; and a step of controlling executed by a controller which controls the image forming device to execute an image adjustment operation for adjusting an image formation condition of the image forming device in the first region of the intermediate transfer body and to execute an operation for forming the image in the second region of the intermediate transfer body.

According to the present invention, the foregoing object is also attained by providing an image forming method executed by an image forming apparatus, the method comprising: a step of image forming executed by an image forming device which forms images on an image carrier, forms the images on an intermediate transfer body including a first region and second region as regions to form the images, and forms the images of a plurality of colors on a printing medium; and a step of controlling executed by a controller which, when an input image formation mode is found to be a color image formation mode by determining whether the input image formation mode is the color image formation mode, controls the image forming device to execute an image adjustment operation for adjusting an image formation condition of the image forming device in the first region of the intermediate transfer body and to execute an operation for forming the image in the second region of the intermediate transfer body.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Preferred embodiments of the present invention will now be described in detail in accordance with the accompanying drawings.

First Embodiment

Figure 1:
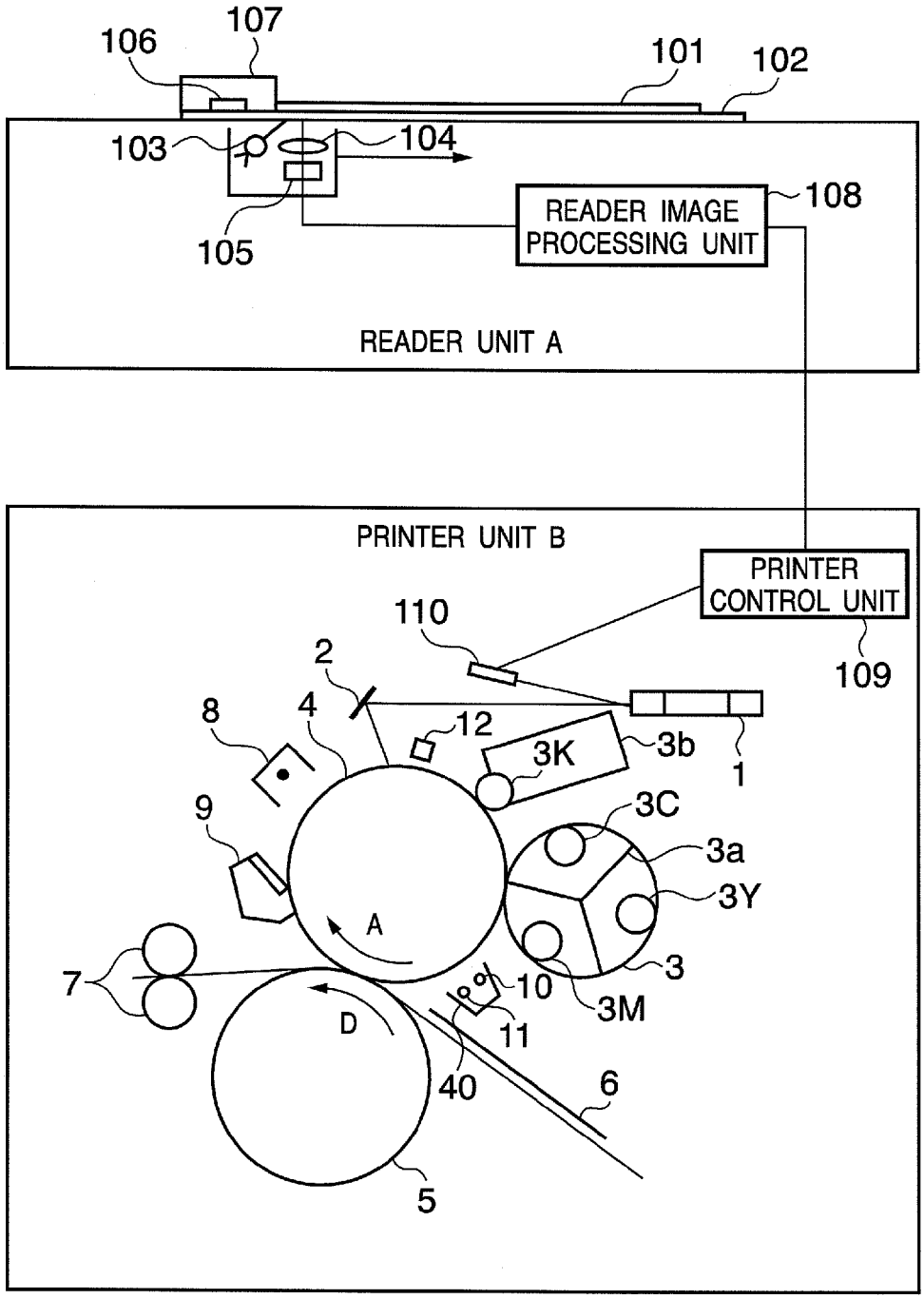
FIG. 1 is a sectional view showing the structure of an image forming apparatus according to the first embodiment of the present invention.

FIG. 1 is a sectional view showing the structure of an image forming apparatus according to the first embodiment of the present invention.

A document 101 placed on a document glass table 102 is irradiated with light emitted from a light source 103 and imaged on a CCD sensor 105 through an optical system 104. The CCD sensor 105 causes CCD line sensors of red, green, and blue which are arrayed in three rows to generate color component signals of red, green, and blue, respectively. These image reading optical system units are scanned in a direction indicated by an arrow so as to convert the document into electrical signal data strings for respective lines.

An abutment member 107 and reference white plate 106 are arranged on the document glass table 102. The abutment member 107 abuts against the document at a corresponding position to prevent it from being obliquely placed. The reference white plate 106 is used to determine the white level of the CCD sensor 105, and to execute shading of the CCD sensor 105 in its thrust direction.

The image signals obtained by the CCD sensor 105 undergo an image process by a reader image processing unit 108. After that, the obtained image signals are sent to a printer unit B and undergo an image process by a printer control unit 109.

Figure 2:
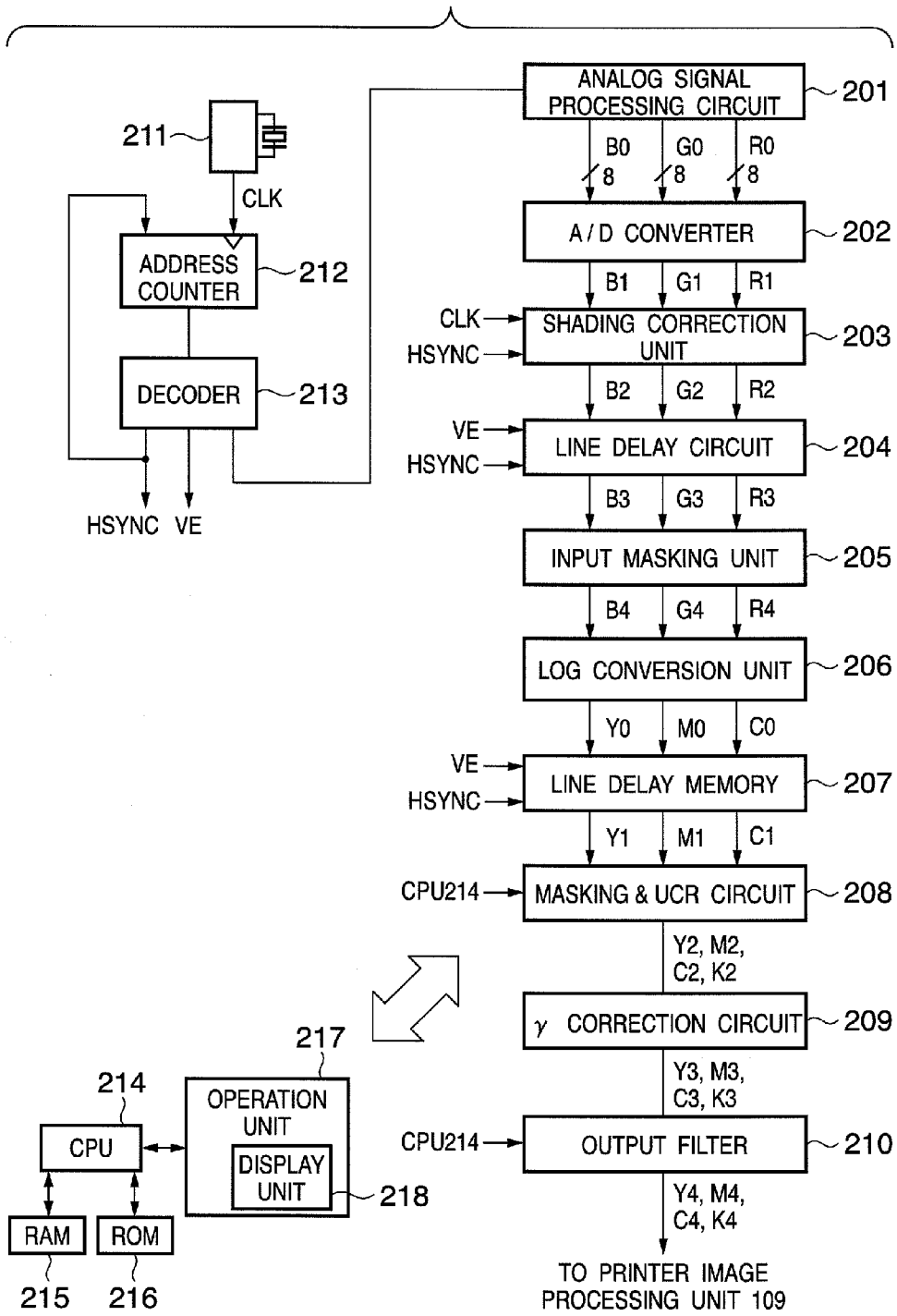
FIG. 2 is a block diagram showing the flows of image signals in a reader image processing unit in a reader unit A according to the first embodiment of the present invention.

The reader image processing unit 108 will be described next. FIG. 2 is a block diagram showing the flows of image signals in the reader image processing unit 108 in a reader unit A according to this embodiment. The image signals output from the CCD sensor 105 (see FIG. 1) are input to an analog signal processing unit 201 and undergo gain and offset adjustments. An A/D converter 202 is then caused to convert the obtained image signals into 8-bit digital image signals R1, G1, and B1 for respective colors. After that, the output signals of the A/D converter 202 are input to a shading correction unit 203 and undergo known shading correction for respective colors using reading signals from the reference white plate 106.

A clock generation unit 211 generates a clock for each pixel. A main scanning address counter 212 counts clocks from the clock generation unit 211 to generate a pixel address output of one line. A decoder 213 decodes the main scanning address from the main scanning address counter 212 to generate a CCD driving signal for each line, such as a shift pulse or reset pulse, a signal VE representing an effective area in a 1-line reading signal from the CCD, or a line sync signal HSYNC. The main scanning address counter 212 is cleared by the line sync signal HSYNC and starts counting the main scanning address of the next line.

The line sensors of the CCD sensor 105 are arranged while being spaced apart from each other by a predetermined distance. A line delay circuit 204 in FIG. 2 corrects a spatial shift in the sub-scanning direction. More specifically, the line delay circuit 204 line-delays R and G signals in the sub-scanning direction with respect to a B signal so as to match the R and G signals with the B signal.

An input masking unit 205 transforms a reading color space determined by the spectral characteristics of R, G, and B filters of the CCD sensor 105 into an NTSC standard color space. The input masking unit 205 performs the following matrix operation:

$$\begin{bmatrix} R4 \\ G4 \\ B4 \end{bmatrix} = \begin{bmatrix} a11 & a12 & a13 \\ a21 & a22 & a23 \\ a31 & a32 & a33 \end{bmatrix} = \begin{bmatrix} R3 \\ G3 \\ B3 \end{bmatrix} \quad (1)$$

A light quantity/density conversion unit (LOG conversion unit) 206 comprises a lookup table ROM to convert luminance signals R4, G4, and B4 into density signals M0, C0, and Y0. A line delay memory 207 causes a black character determination unit (not shown) to delay the image signals M0, C0, and Y0 by line delay components up to determination signals such as UCR, FILTER, and SEN generated from the signals R4, G4, and B4.

A masking & UCR circuit 208 extracts a black signal (K) using the input three primary signals M1, C1, and Y1. Furthermore, the masking & UCR circuit 208 performs an arithmetic operation for correcting the color grayness of a printing coloring material in the printer unit B. The masking & UCR circuit 208 in turn outputs signals M2, C2, and K2 with a predetermined bit width (8 bit) in every reading operation.

A γ correction circuit 209 in the reader unit A executes density correction so as to match the γ characteristic with an ideal tone characteristic of the printer unit B. A space filter processing unit (output filter) 210 executes an edge enhancement or smoothing process.

The frame sequential image signals M4, C4, Y4, and Bk4 thus processed are sent to the printer control unit 109 in the printer unit B and undergo density recording by PWM.

A CPU 214 controls the reader unit and connects to a RAM 215 and ROM 216. An operation unit 217 includes a display unit 218.

Figure 3:
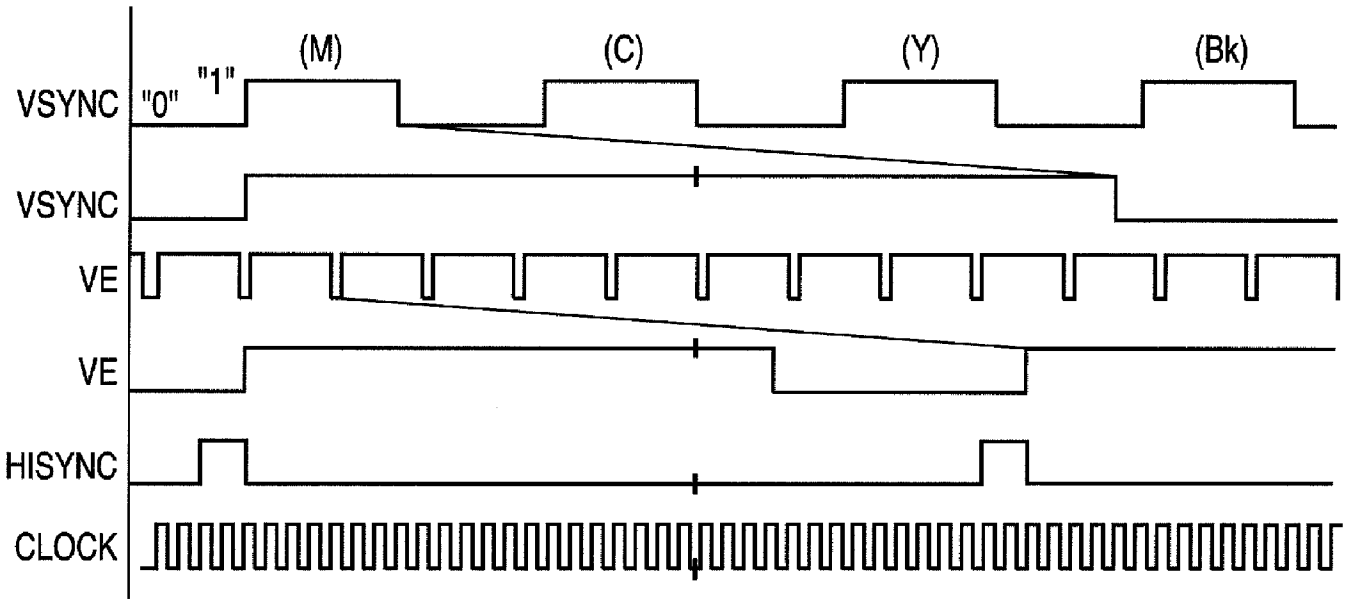
FIG. 3 is a timing chart showing the timings of respective control signals in the image processing unit shown in FIG. 2.

FIG. 3 is a timing chart showing the timings of respective control signals in the image processing unit 108 shown in FIG. 2. Referring to FIG. 3, a VSYNC signal is an image effective interval signal in the sub-scanning direction. In a logic "1" interval, the VSYNC signal is used to read (scan) an image, thereby in turn forming output signals (M), (C), (Y), and (K). A VE signal is an image effective interval signal in the main scanning direction and synchronizes to the line sync signal HSYNC. In the logic "1" interval, the VE signal is also used to detect the timing of the main scanning start position to mainly control line counting in line delay. A CLOCK signal is a pixel sync signal and used to transfer image data at a leading edge timing of "0"→"1".

The printer unit B will be described next. Referring to FIG. 1, a charger 8 is a corona charger. A bias is applied to the charger 8 to uniformly negatively charge the surface of the photosensitive drum 4 as an image carrier. In this embodiment, −500V is charged. The image data is converted into a laser beam through a laser light source 110 and a laser driver included in the printer control unit 109. The laser beam is reflected by a polygon mirror 1 and mirror 2 and strikes the uniformly charged photosensitive drum 4. The photosensitive drum 4 on which a latent image is formed by laser beam scanning rotates in a direction indicated by an arrow A shown in FIG. 1.

Figure 27:
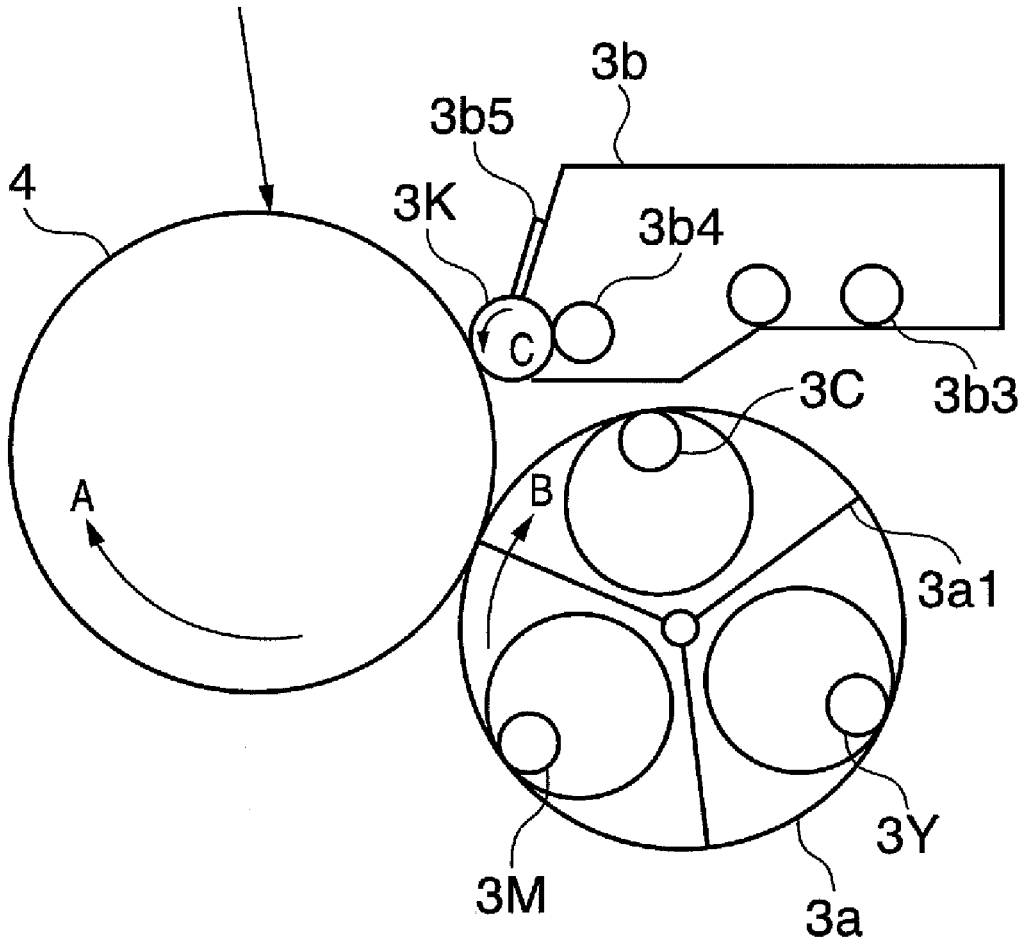
FIG. 27 is a sectional view showing the detailed structure of a developing means according to the first embodiment.

FIG. 27 is a sectional view showing details of the developing unit 3. The developing unit 3 comprises a rotary developing unit 3*a* and stationary developing unit 3*b*. The developing unit 3*a* switches among the magenta toner developing unit 3M, yellow toner developing unit 3Y, and cyan toner developing unit 3C. The developing unit 3*b* includes the black toner developing unit 3K. In this embodiment, magnetic monocomponent toner is adopted for black, and a two-component developer containing a magnetic carrier and nonmagnetic toner is adopted for the other three colors.

The rotary developing unit 3*a* is supported by a rotation support device 3*a*1 so as to be rotatable in a direction indicated by an arrow B in FIG. 3. The color toner developing units 3M, 3Y, and 3C develop the images using corresponding color toners while opposing the photosensitive drum 4 in turn. The rotary developing unit 3*a* is formed as a process cartridge detachable from the apparatus main body. When the toners in the color toner developing units 3M, 3Y, and 3C are used up, the rotary developing unit 3*a* is replaced. This makes it possible to form an image again.

The stationary developing unit 3*b* comprises a developing unit which accommodates black toner to be consumed in large quantities. The developing unit 3*b* is formed as a process cartridge detachable from the apparatus main body, like the rotary developing unit 3*a*. While the stationary developing unit 3*b* is attached to the apparatus main body, the developing sleeve serving as a rotatable toner carrier is held to have a small gap (in this embodiment, 50 μm to 500 μm) with respect to the photosensitive drum 4. A development region to supply the toner carried by the developing sleeve to the photosensitive drum 4 is thus formed.

A feed unit 3*b*3 to feed toner to the developing sleeve side of the black toner developing unit 3K is also provided in the toner container. A supply roller 3*b*4 to supply the toner fed by the feed unit 3*b*3 to the developing sleeve is accommodated in the toner container. In order to attain uniform toner coating and stable supply to the developing sleeve, foam rubber such as polyurethane or silicone is preferably adopted as the material of the supply roller 3*b*4. Furthermore, it is preferable to make the supply roller 3*b*4 abut against the developing sleeve and to rotate the supply roller 3*b*4 in a direction indicated by an arrow C in FIG. 27 while keeping a peripheral velocity difference between the developing sleeve and the supply roller 3*b*4. A developing blade 3*b*5 serving as a regulating member to regulate the layer thickness of toner carried by the developing sleeve is provided on the developing sleeve.

The laser beam source 110 exposes the charged photosensitive drum 4 by being turned on/off in correspondence with image data of the first color (e.g., magenta) to form an electrostatic latent image (in this embodiment, about −150 V) of the first color thereon. This electrostatic latent image of the first color is developed and visualized by the magenta toner developing unit 3M containing magenta toner (negative polarity) of the first color. At the nip portion between the photosensitive drum 4 and the transfer drum 5 as an intermediate transfer body, this visualized first toner image is transferred onto a printing medium 6 carried on the transfer drum 5. The transfer drum 5 is rotationally driven at a velocity (in this embodiment, 265 mm/s) almost equal to the peripheral velocity of the photosensitive drum 4 in a direction indicated by an arrow D.

Toner which remains on the photosensitive drum 4 without being transferred onto the printing medium 6 in the transfer process is scraped by a cleaning blade as a cleaning unit 9 and is recovered by a waste toner container.

The above-described transfer process is similarly repeated for the other toners (yellow, cyan, and black). Every time this process is repeated, toner images of colors contained in the corresponding developing units are in turn transferred and superimposed on the printing medium 6 carried on the transfer drum 5, thus a full-color image is formed.

The printing medium 6 on which the full-color image is formed by the above processes is removed from the surface of the transfer drum 5. After that, the printing medium 6 is conveyed to a fixing device by a convey means to cause a fixing unit 7 to thermally fix and discharge it.

Assume that a monochrome image is to be formed in the image forming apparatus having the above structure shown in FIG. 1. Since the black toner developing unit 3K is used as the stationary developing unit 3*b*, images can be continuously formed at high speed without activating the rotary developing unit 3*a* including the color developing units.

A toner patch detection device (to be also merely referred to as a detection device hereinafter) 40 to detect the amount of light reflected by the toner patch pattern formed on the photosensitive drum 4 is also arranged in the image forming apparatus according to this embodiment. The detection device 40 comprises an LED light source 10 (with a dominant wavelength of around 960 nm) and photodiode 11.

Figure 4:
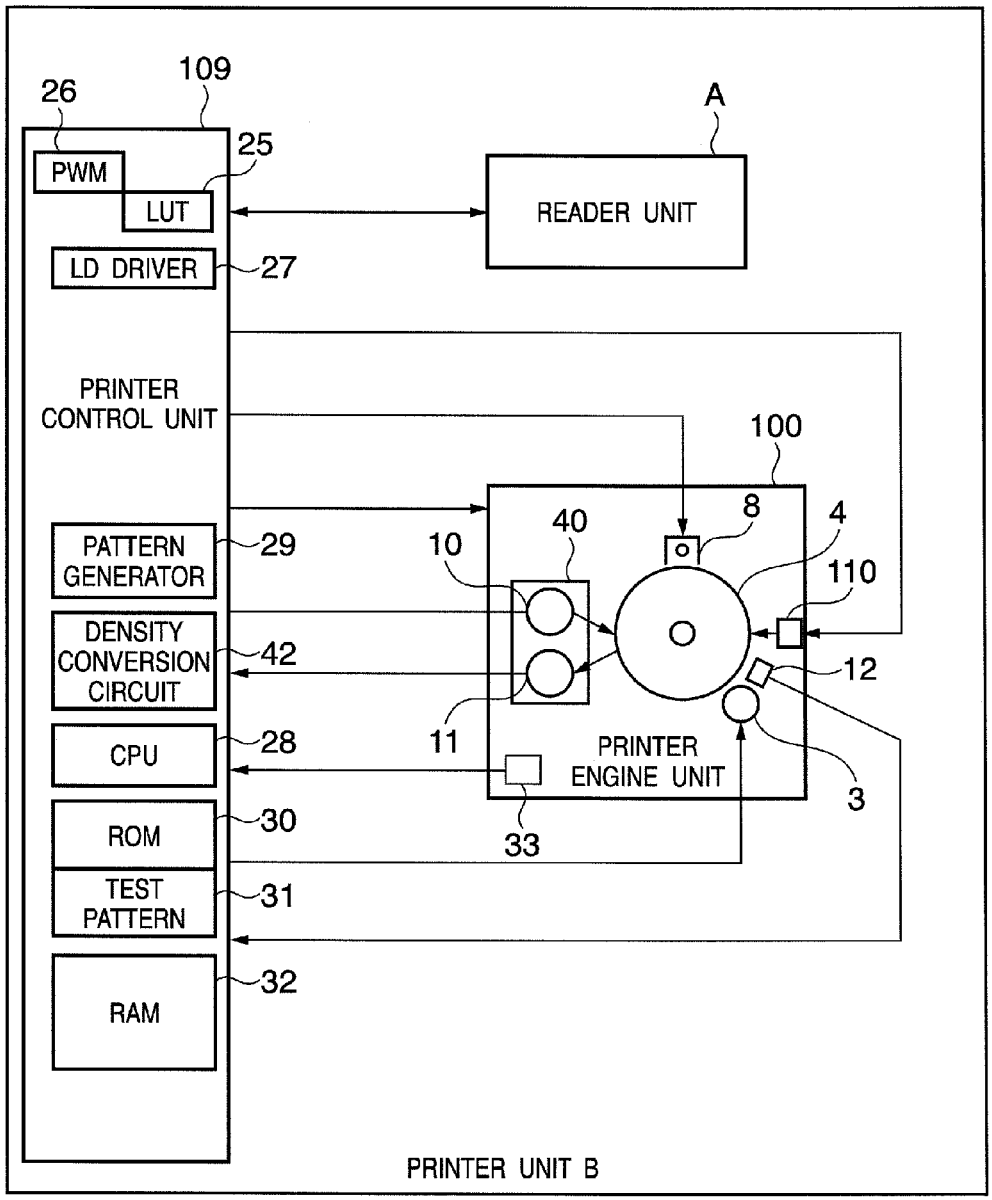
FIG. 4 is a block diagram showing the arrangement of the image forming apparatus according to the first embodiment.

FIG. 4 is a block diagram showing the arrangement of the image forming apparatus according to the first embodiment.

The printer control unit 109 comprises a CPU 28, ROM 30, RAM 32, test pattern storage unit 31, density conversion circuit 42, and LUT 25. The printer control unit 109 can communicate with the reader unit A and a printer engine unit 100.

The printer control unit 109 is connected with the detection device 40 including the LED light source 10 and photodiode 11, a primary charger 8, the laser light source 110, a surface potential sensor 12, and the developing unit 3.

An environment sensor 33 to measure the water content in air in the apparatus is provided in the printer engine unit 100. The surface potential sensor 12 is arranged upstream of the developing unit 3. The grid potential of the primary charger 8 and the development bias of the developing unit 3 are controlled by the CPU 28, as will be described later.

Figure 5:
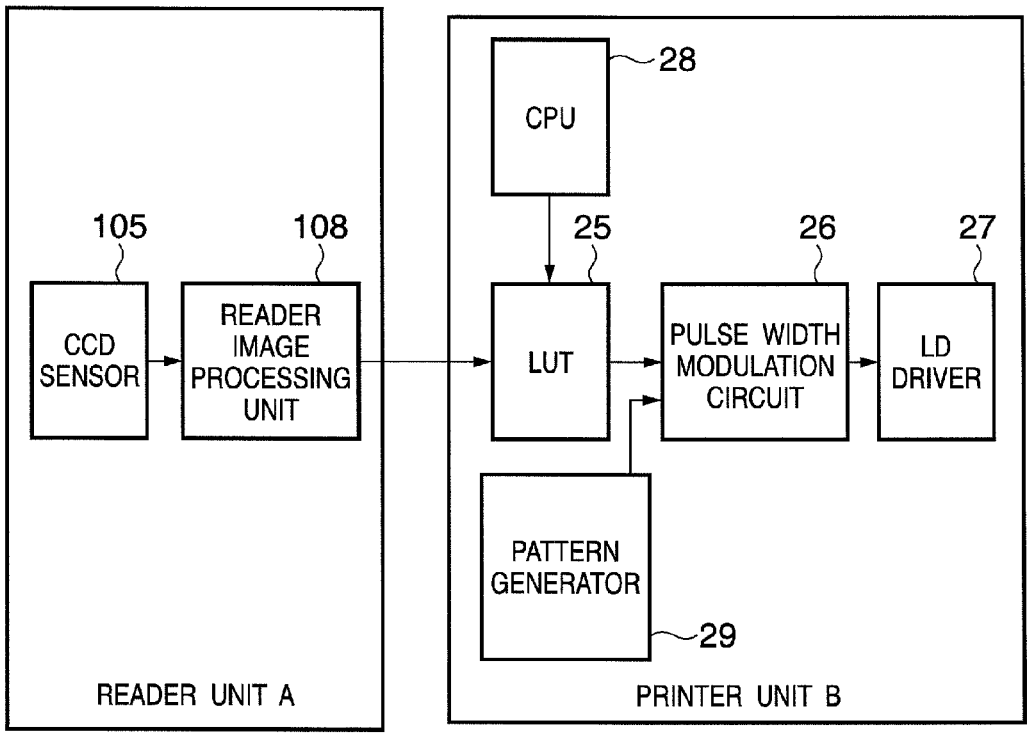
FIG. 5 is a block diagram showing an image signal processing circuit to obtain a tone image in the first embodiment.

FIG. 5 is a block diagram showing an image signal processing circuit to obtain a tone image in this embodiment. Luminance signals of an image are obtained by the CCD sensor 105 and converted into frame sequential image signals by the reader image processing unit 108. The density characteristic of each of these image signals is converted using the LUT 25 so as to match the densities of an original image and output image which are represented by image signals to which the γ characteristic of the printer in initial setting is input.

Figure 6:
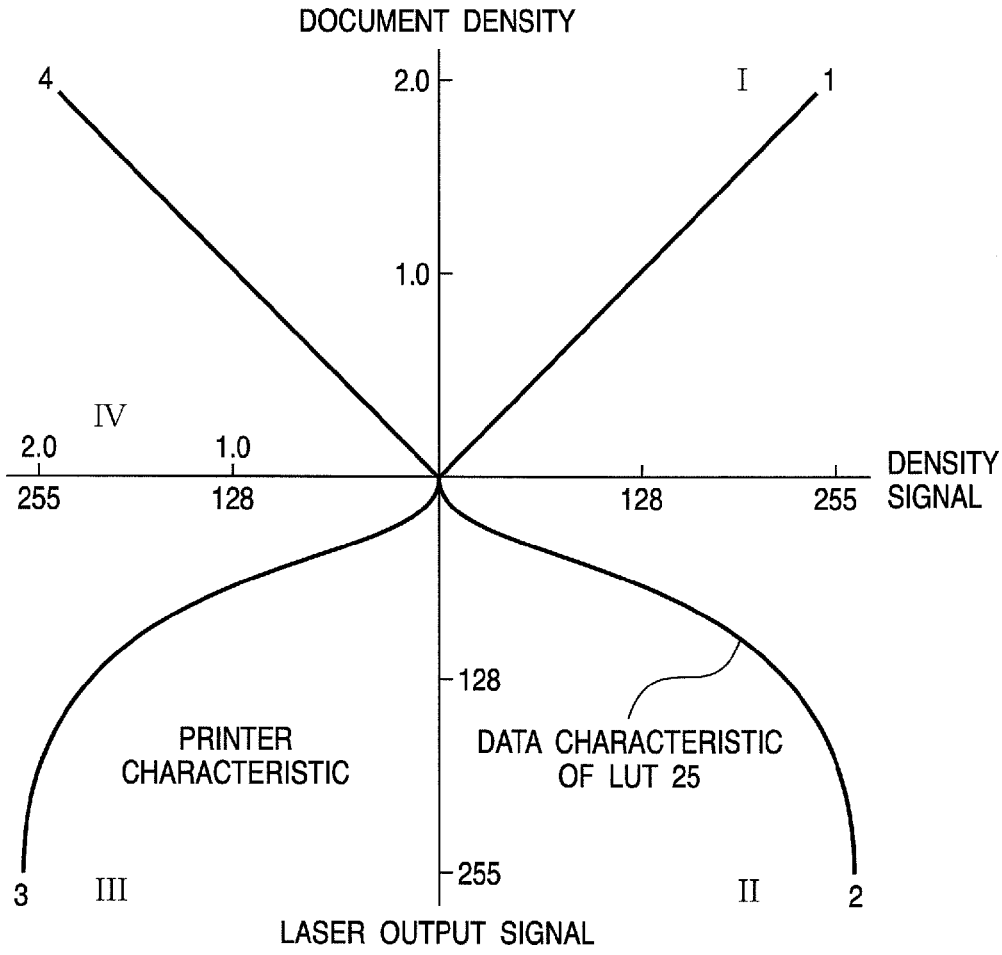
FIG. 6 is a graph showing tone reproduction.

FIG. 6 is a graph showing tone reproduction.

The I-st quadrant represents the reading characteristic of the reader unit A to convert a document density into a density signal. The II-nd quadrant represents the conversion characteristic of the LUT 25 to convert the density signal into a laser output signal. The III-rd quadrant represents the printing characteristic of the printer unit B to convert the laser output signal into an output density. The IV-th quadrant represents the total tone reproduction characteristic of the image forming apparatus, i.e., the relationship between the document density and the output density.

The number of gray levels is 256 since the data involved are processed by 8-bit digital signals. To obtain linear tone characteristic in the IV-th quadrant, this image forming apparatus corrects, using the LUT 25 in the IV-th quadrant, the nonlinear components of the printer characteristic in the III-rd quadrant. The LUT 25 is generated in accordance with an arithmetic result (to be described later).

The signal having undergone density conversion by the LUT 25 is converted into a signal corresponding to the dot width by a pulse width modulation (PWM) circuit 26 and sent to a laser driver 27 which ON/OFF-controls a laser. In this embodiment, a tone reproduction method using a pulse width modulation process is applied to all colors, i.e., M, C, Y, and K.

By scanning the laser light source 110, a latent image having a predetermined tone characteristic is formed on the photosensitive drum 4 upon a change in dot area. An image adjustment means of the image forming apparatus used in this embodiment will be described in detail here.

The image forming apparatus used in this embodiment has first and second control systems as the image adjustment means.

(First Control System)

Figure 7:
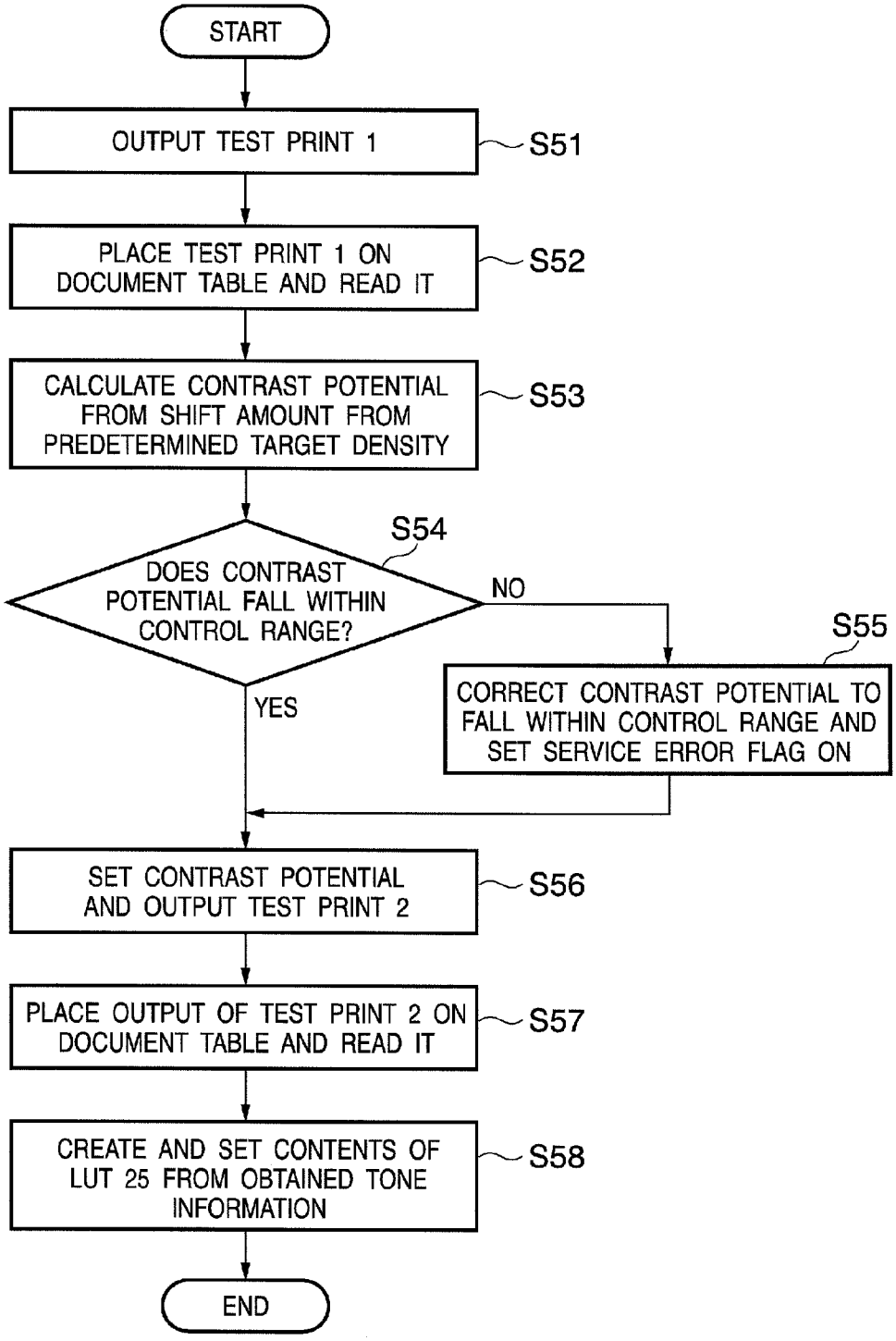
FIG. 7 is a flowchart showing the flow of calibration of a printer unit B using the reader unit A.

The first control system associated with stabilization of the image reproduction characteristic of the system including both the reader unit A and printer unit B will be described first. FIG. 7 is a flowchart showing the flow of calibration of the printer unit B using the reader unit A. This flow is implemented by the CPUs 214 and 28 which control the reader unit A and printer unit B, respectively.

By pressing an automatic tone correction mode setting button displayed on the operation unit 217, the control operation starts. FIGS. 8A to 8C to 10A to 10E are views showing display transition on a display unit. In this embodiment, a display unit 218 is formed from a liquid crystal operation panel (touch panel display) having push sensors as shown in FIGS. 8A to 8C to 10A to 10E.

Figure 11:
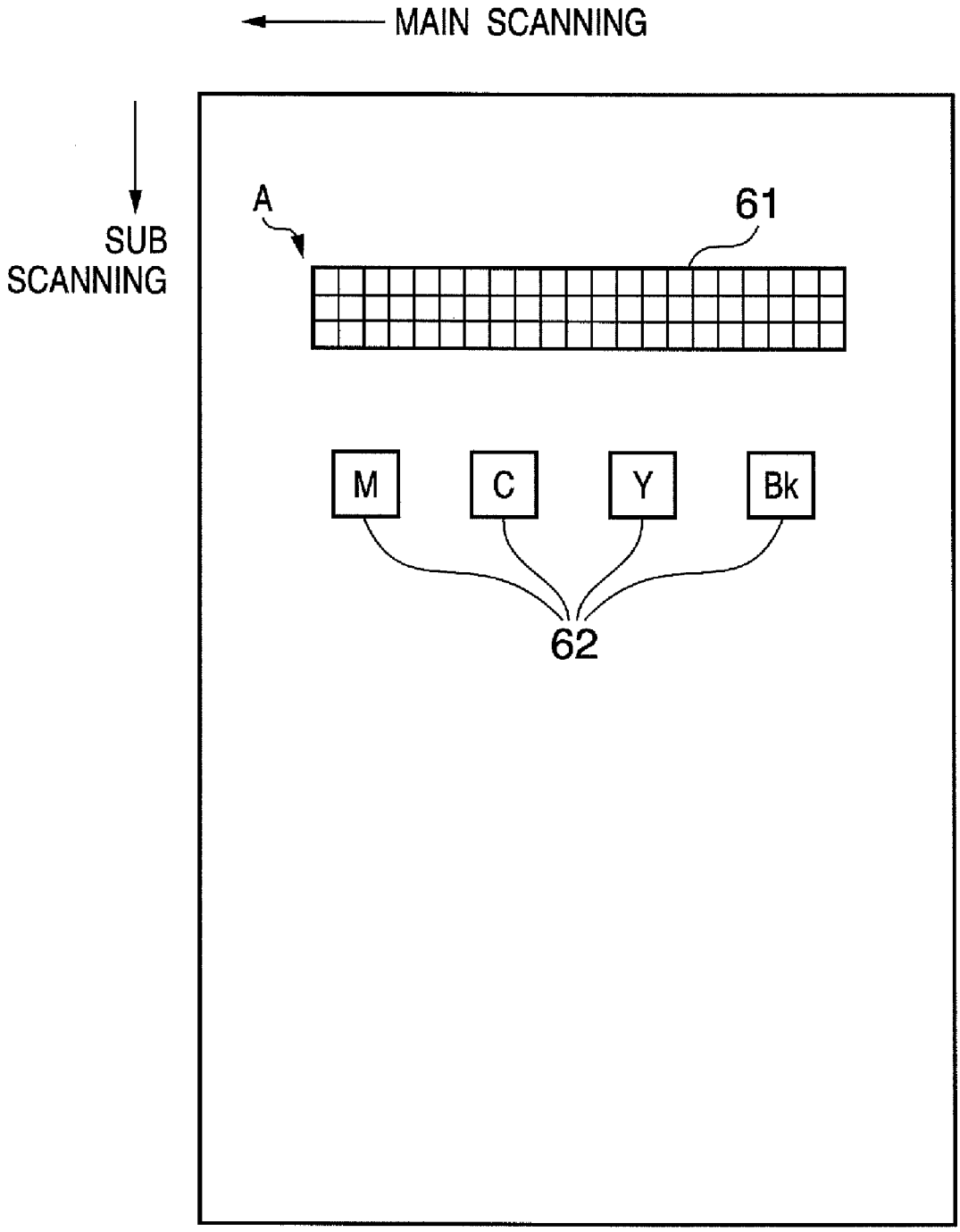
FIG. 11 is a view showing an example of test print 1.

Referring back to FIG. 7, a print start button 81 of test print 1 is displayed on the display unit 218 (FIG. 8A) in step S51. By pressing this button, an image of test print 1 shown in FIG. 11 is printed out by the printer unit B.

Figure 8A:
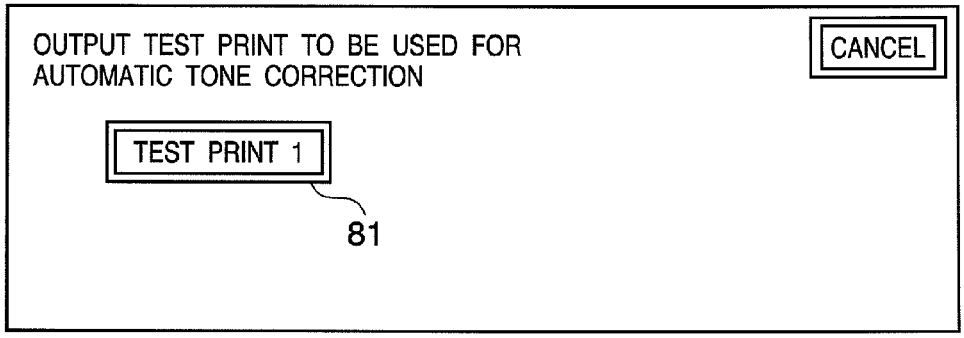
FIGS. 8A to 8C are views illustrating the display contents of a display unit 218.
Figure 8B:
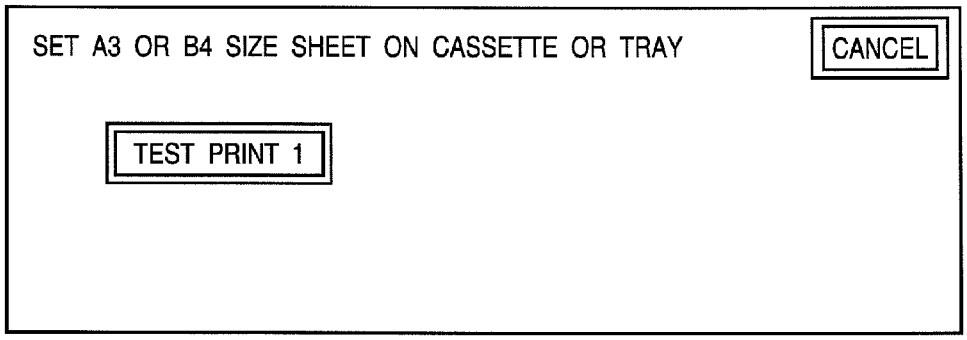
Figure 8C:
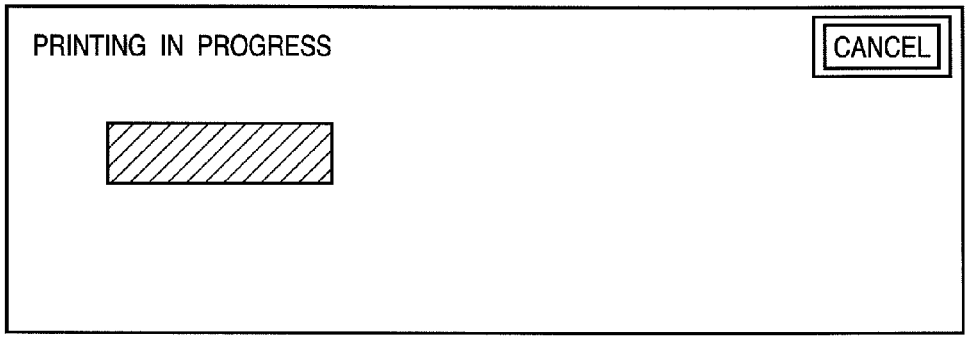

At this time, the CPU 214 determines the presence/absence of a paper sheet to form test print 1. If there is no paper sheet, a warning as shown in FIG. 8B is displayed. In forming test print 1, a standard contrast potential (details thereof will be described later) suitable for the environment is registered and used as the initial value.

The image forming apparatus used in this embodiment comprises a plurality of sheet cassettes so as to allow to select a plurality of types of paper sizes such as B4, A3, A4, and B5.

However, a so-called large-size paper sheet is adopted as the print paper sheet to be used in this control operation so as to avoid any errors due to the confusion between portrait and landscape modes in the subsequent reading operation. That is, the paper size is set to be selectable from B4, A3, 11×17, and LGR for use.

FIG. 11 is a view showing test pattern 1. A belt-shaped pattern 61 due to the halftone densities of four colors M, C, Y, and K is formed.

The pattern 61 is visually inspected to confirm that there are no striped abnormal image, density variation, and color variation. The size of this pattern 61 in the main scanning direction of the CCD sensor 105 is so set as to cover a patch pattern 62 and tone patterns 71 and 72 (FIG. 12) in its thrust direction.

If any abnormality is found, test print 1 is printed again. If any abnormality is found again, a serviceman call is made.

It is also possible to cause the reader unit A to read the belt-shaped pattern 61 to automatically determine whether to execute the subsequent control operation on the basis of the obtained density information in its thrust direction. The pattern 62 uses maximum density patches of respective colors M, C, Y, and K which have density signal values of level 255.

Figure 9A:
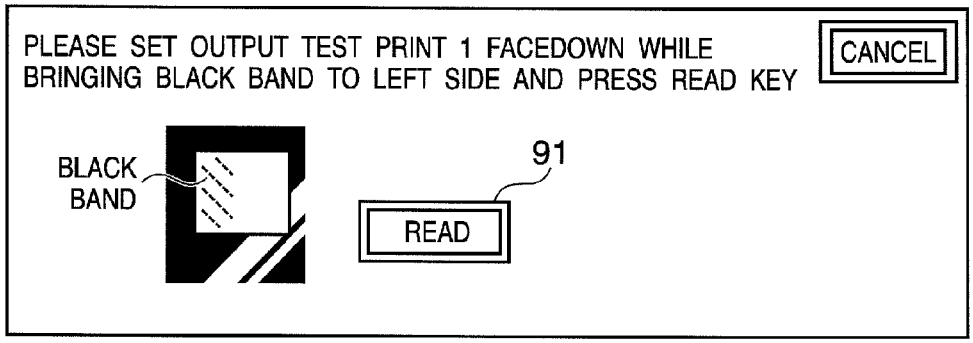
FIGS. 9A to 9C are views illustrating the display contents of the display unit 218.
Figure 13:
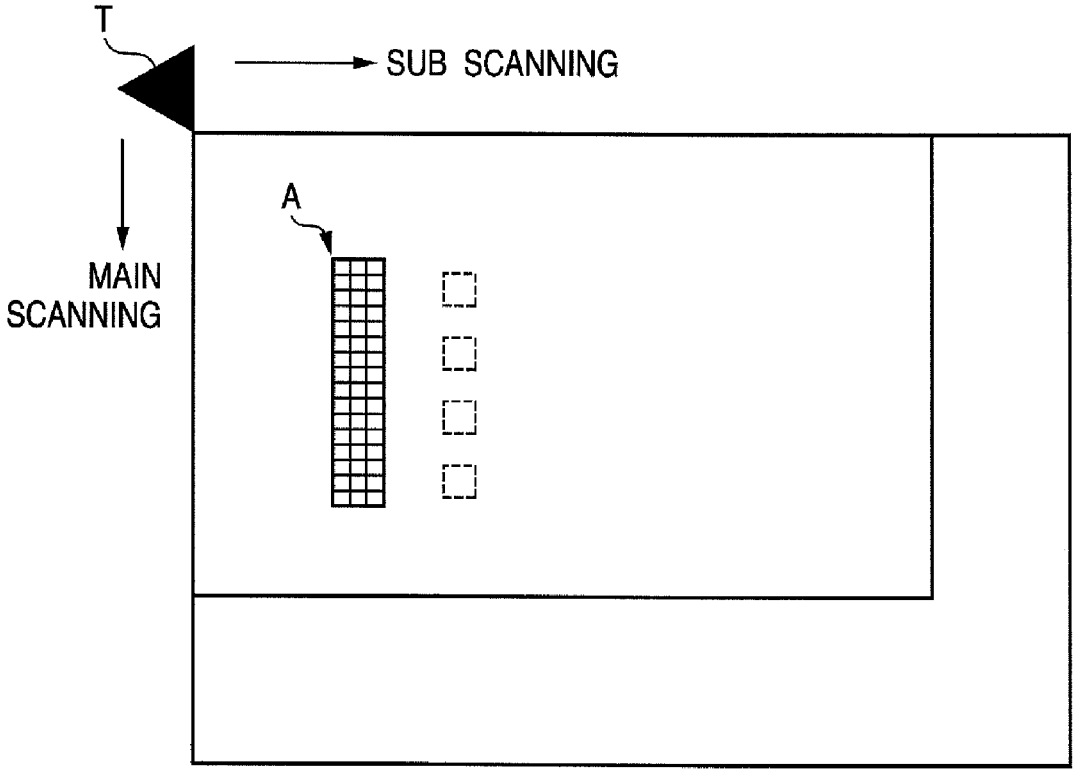
FIG. 13 is a view for explaining an operation for setting a result of test print 1 on a document table.

In step S52, the image of test print 1 is placed on the document glass table 102 as shown in FIG. 13, and a reading start button 91 shown in FIG. 9A is pressed. A guidance message for the operator shown in FIG. 9A is displayed.

FIG. 13 is a view when the document table is seen from above. An upper left wedge mark T is a document abutment mark on the document table. The above-described message is displayed on the operation panel (FIG. 9A) so as to prompt the operator to bring the belt-shaped pattern 61 to the abutment mark T side and to avoid any confusion between the front and back sides. This makes it possible to prevent any errors due to misplacement.

To read the pattern 62 using the reader unit A, it is gradually scanned from the abutment mark T. A first density gap point A can be obtained at the corner of the pattern 61. The patch positions of the pattern 62 are calculated by relative coordinates from these coordinate points to read the density values of the pattern 62.

Figure 9B:
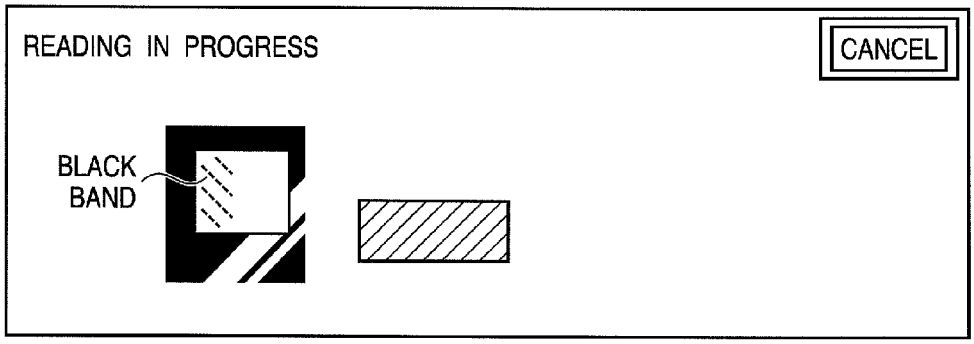
Figure 9C:
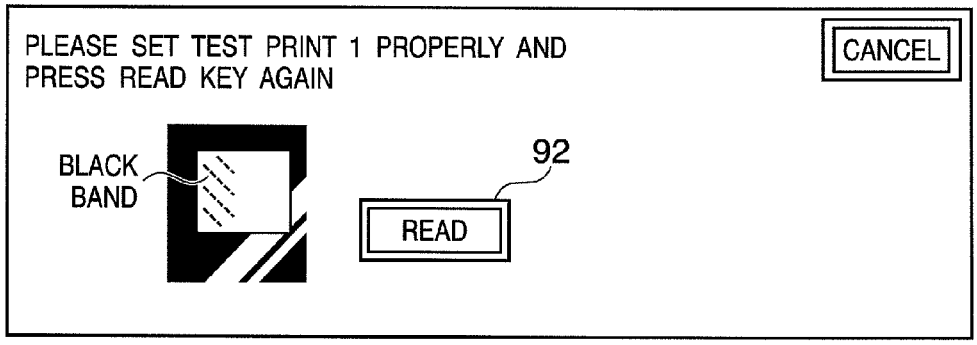

A message shown in FIG. 9B is displayed during reading. If the orientation or position of test print 1 is inaccurate and unreadable, a message shown in FIG. 9C is displayed. When the operator places test print 1 in a proper state, he/she presses a read key 92 to read it again.

To convert the obtained RGB values into the optical densities, the following equation (2) is used. The optical densities are adjusted by a correction coefficient (k) to be equal to those obtained by a commercially available densitometer.

$$M=-km\times\log 10(G/255)$$

$$C=-kc\times\log 10(R/255)$$

$$Y=-ky\times\log 10(B/255)$$

$$Bk=-kbk\times\log 10(G/255) \quad (2)$$

Alternatively, RGB luminance information may be converted into MCYK density information using another LUT.

Figure 15:
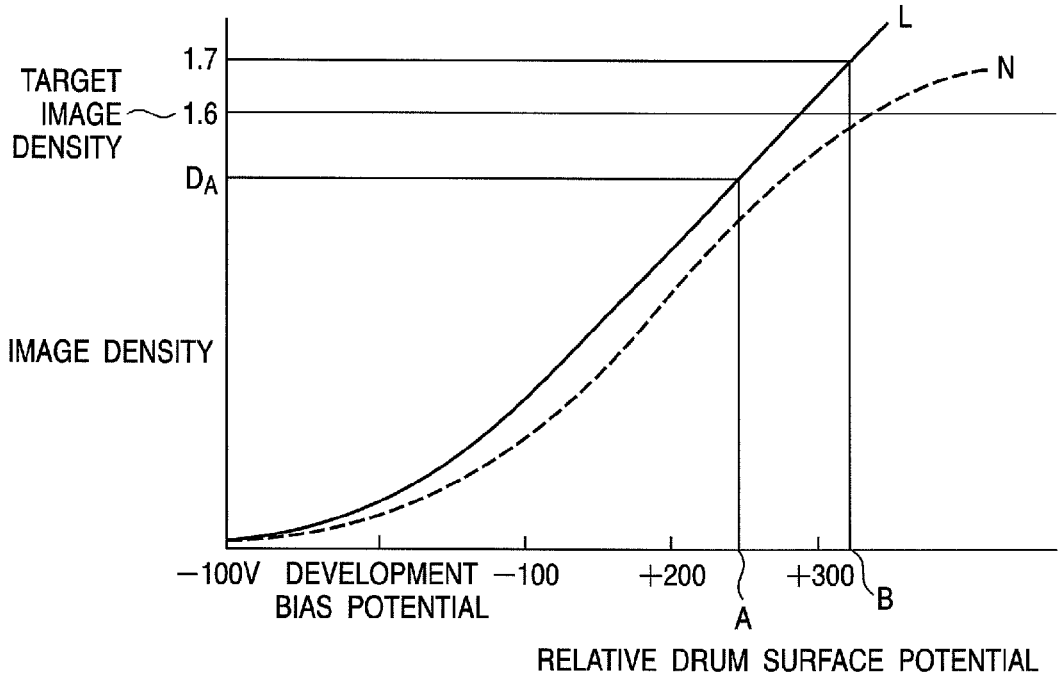
FIG. 15 is a graph showing the relationship between the relative drum surface potential and the image density obtained by the above-described arithmetic operation.

A method of correcting a maximum density from the obtained density information (to be referred to as maximum density correction hereinafter) will be described next. FIG. 15 is a graph showing the relationship between the relative drum surface potential and the image density obtained by the above-described arithmetic operation. Assume that the contrast potential used at that point, i.e., the difference between the development bias potential and the surface potential of the photosensitive drum that reaches a maximum level using a laser beam after its primary charging is set to A. In a case where the image density is a maximum density DA obtained in the setting A, in a maximum density region, the image density exhibits linearity with respect to the relative drum surface potential as indicated by a solid line L in most cases.

In a two-component developing system, however, if the density of toner in a developing unit lowers, the image density exhibits a nonlinear characteristic in a maximum density region as indicated by a broken line N in some cases.

In this case, the final target value of the maximum density is set to 1.6. However, a controlled variable is determined by setting the target value for maximum density matching control to 1.7 in consideration of a margin of 0.1. A contrast potential B here can be calculated by:

$$B=(A+Ka)\times 1.7/DA \quad (3)$$

where Ka is a correction coefficient. The value of the coefficient Ka is preferably optimized in correspondence with the type of developing method.

Figure 16:
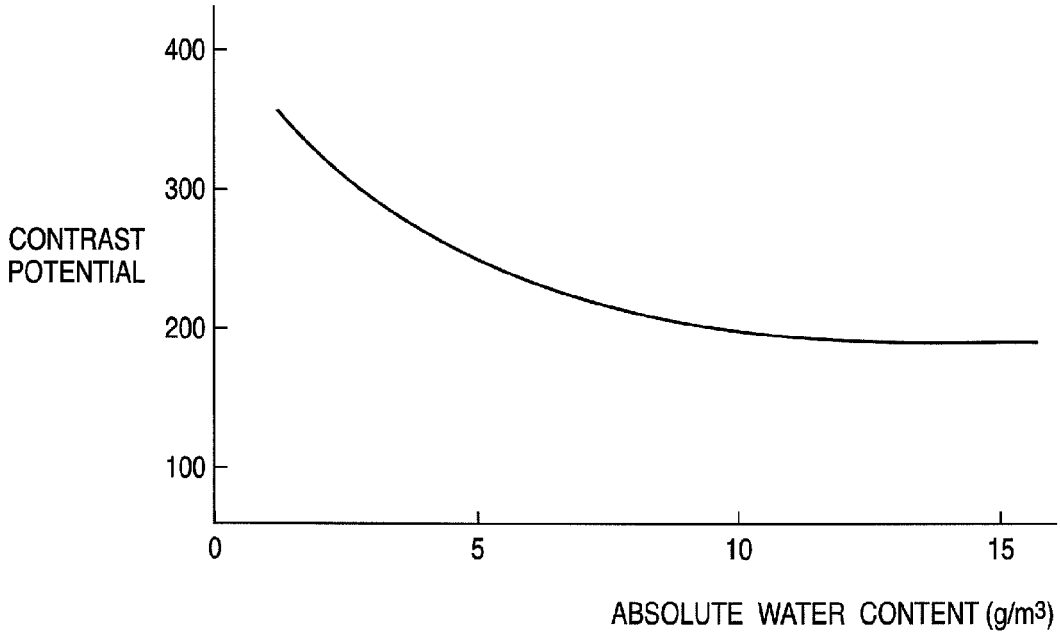
FIG. 16 is a graph showing the relationship between the absolute water content and the contrast potential.

In the electrophotographic method, the image density does not match unless the setting of the contrast potential A is changed depending on the environment. Therefore, the setting is changed depending on the output from the above-described environment sensor 33 which monitors the water content in the apparatus, as expressed by the relationship between the absolute water content and the contrast potential shown in FIG. 16.

Accordingly, as a method of correcting the contrast potential, a correction coefficient Vcont·rate1 is saved in a backed-up RAM.

$$V\text{cont}\cdot\text{rate1}=B/A \quad (4)$$

The image forming apparatus monitors a change in environment (water content) for every 30 min. Every time the apparatus determines the value of the contrast potential A on the basis of the detection result, A×Vcont·rate1 can be calculated to obtain the contrast potential.

Figure 17:
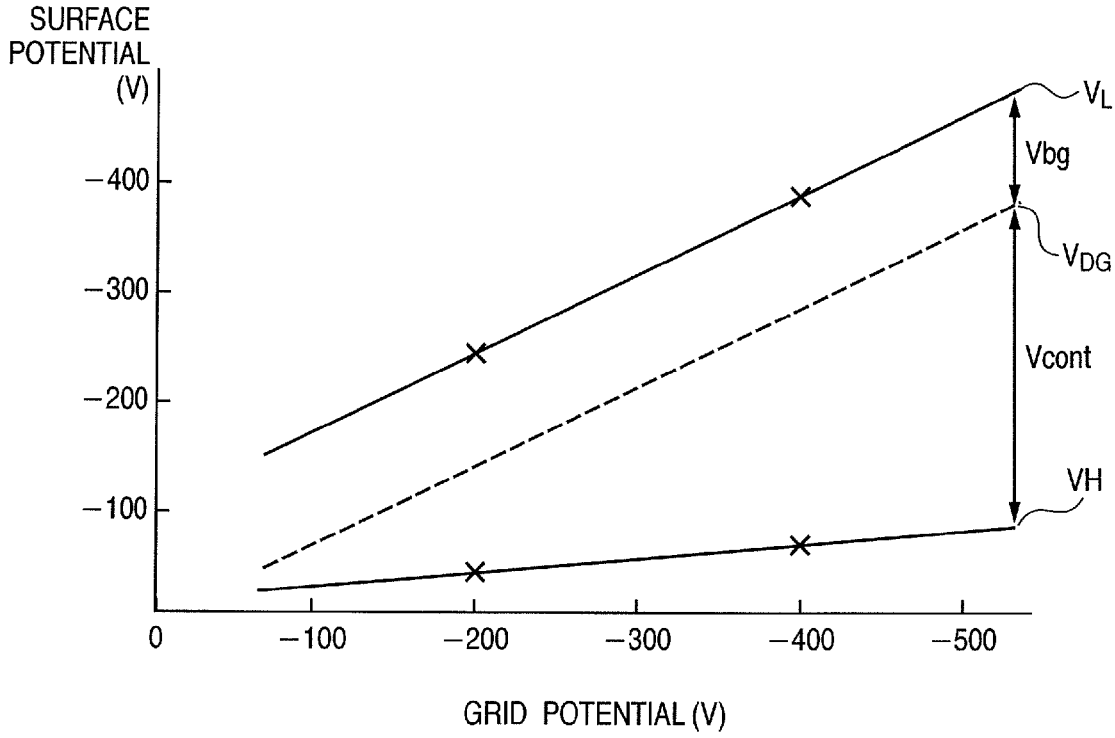
FIG. 17 is a graph showing the relationship between the grid potential and the photosensitive drum.

How to calculate the grid potential and development bias potential from the contrast potential will be simply described. FIG. 17 is a graph showing the relationship between the grid potential and the photosensitive drum.

The grid potential is set to −200 V. Surface potentials VL and VH when scanning is performed upon setting a laser beam to minimum and maximum levels, respectively, are measured by the surface potential sensor 12. Similarly, the surface potential sensor 12 measures the surface potentials VL and VH when the grid potential is set to −400 V. Interpolating and extrapolating the data of −200 V and −400 V makes it possible to obtain the relationship between the grid potential and the surface potential. This potential data calculation control operation is called potential measurement control.

A difference Vbg (set to 100 V in this case) from the surface potential VL, that is so set as to prevent fogging toner from adhering to the surface of the image is given to set a development bias VDC.

A contrast potential Vcont is the difference voltage between the development biases VDC and the surface potential VH. As the potential Vcont rises, the maximum density increases, as described above. A specific grid potential and specific development bias potential required to obtain the calculated contrast potential B can be calculated from the relationship in FIG. 17.

Referring back to the flowchart in FIG. 7, the contrast potential is calculated in step S53 such that the maximum density becomes higher than the final target value by 0.1. To attain this contrast potential, the CPU 28 sets the grid potential and development bias potential.

It is determined in step S54 whether the calculated contrast potential falls within the control range. If the calculated contrast potential falls outside the control range (S54—NO), it is determined that a developing unit has abnormality. To cause a serviceman to check a developing unit of a corresponding color, an error flag that is recognizable for him/her is set ON so as to allow him/her to see it in a predetermined service mode (S55).

In this case, at the time of such abnormality occurrence, a value that barely falls within the control range is corrected under the control of a limiter, thus continuing the control operation.

As described above, the grid potential and development bias potential are set by the CPU 28 such that they match the contrast potential calculated in step S53.

Figure 24:
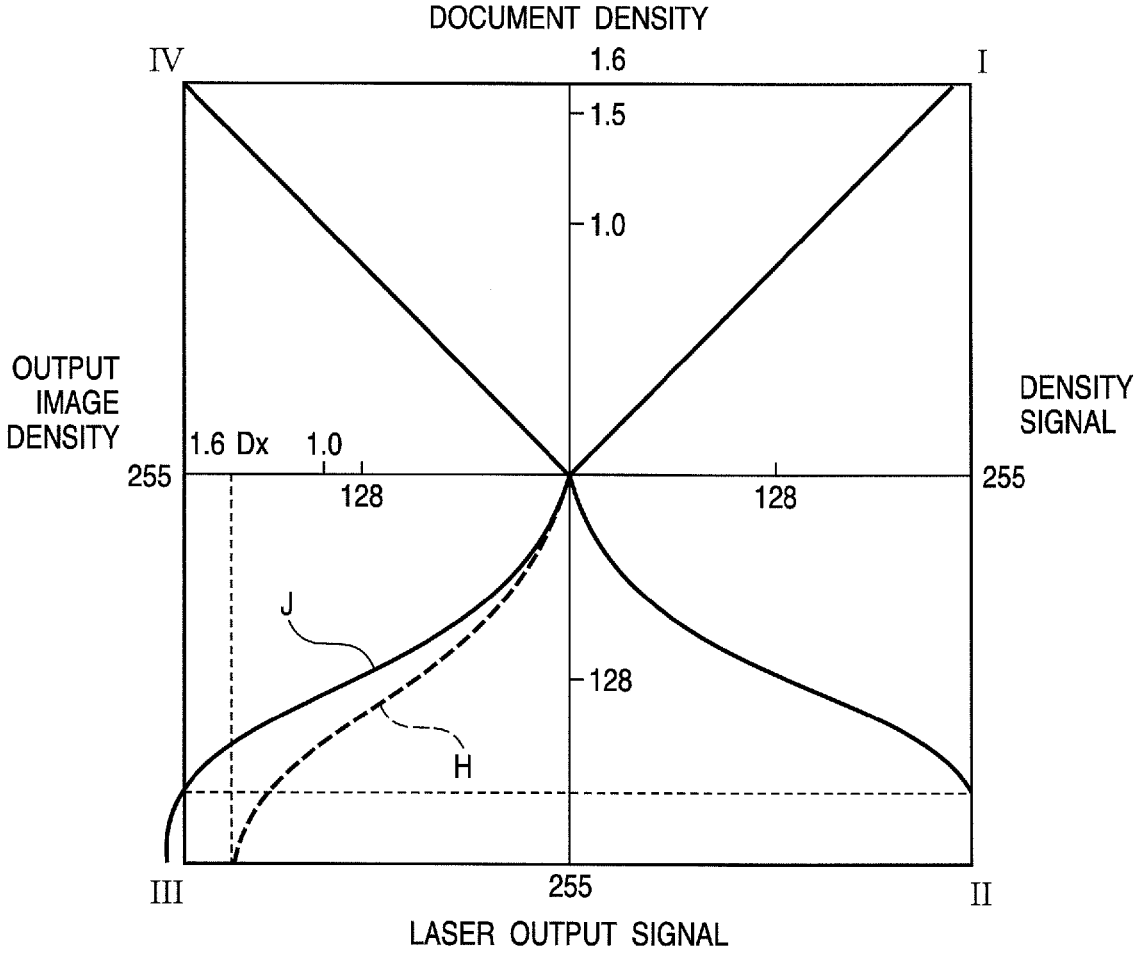
FIG. 24 is a graph showing the density conversion characteristic.
Figure 25:
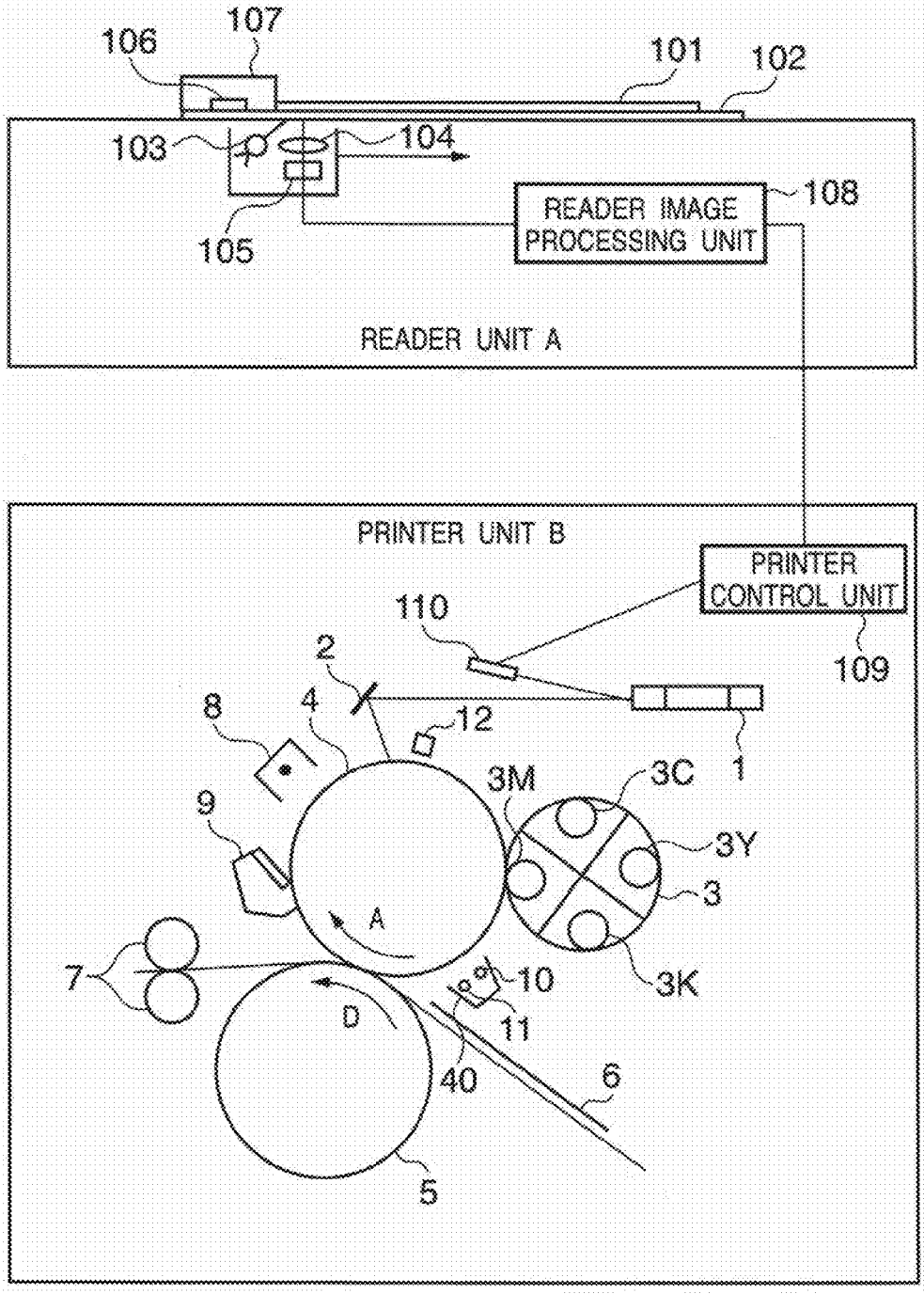
FIG. 25 (Prior Art)
FIG. 25 is a sectional view showing the structure of the conventional image forming apparatus.

FIG. 24 is a graph showing the density conversion characteristic. The printer characteristic in the III-th quadrant exhibits a curve indicated by a solid line J, under maximum density control for setting the maximum density in this embodiment higher than the final target value. Unless such a control operation is executed, the printer characteristic may exhibit a curve indicated by a broken line H and so its maximum density may not reach 1.6. In case of the characteristic indicated by the broken line H, any settings of the LUT 25 cannot reproduce a density between the density DH and 1.6 because the LUT 25 has no capability to increase the maximum density.

If the final target value is set to a value that barely exceeds the maximum density as indicated by the solid line J, the density reproduction region can be assured in the total tone characteristic in the IV-th quadrant.

Figure 10A:
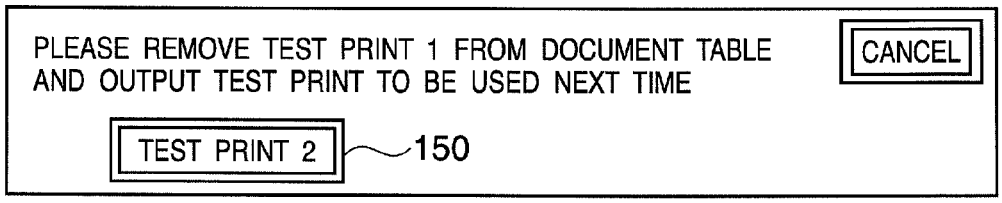
FIGS. 10A to 10E are views illustrating the display contents of the display unit 218.
Figure 10B:
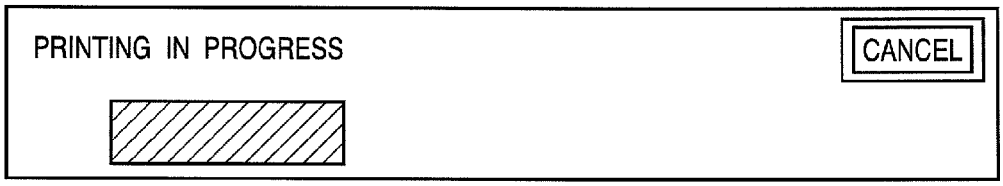
Figure 10C:
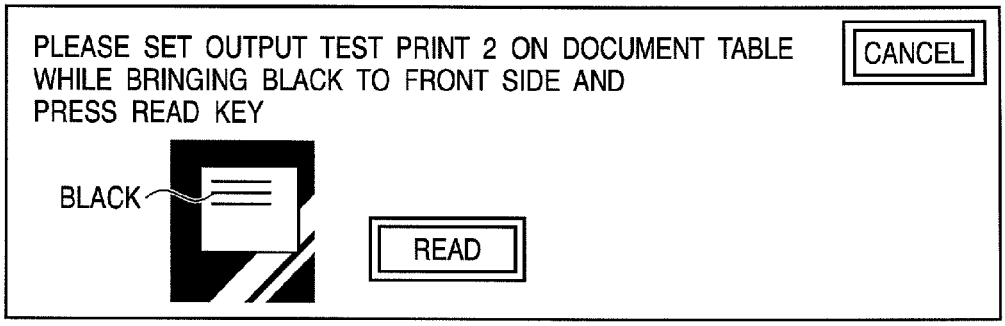
Figure 12:
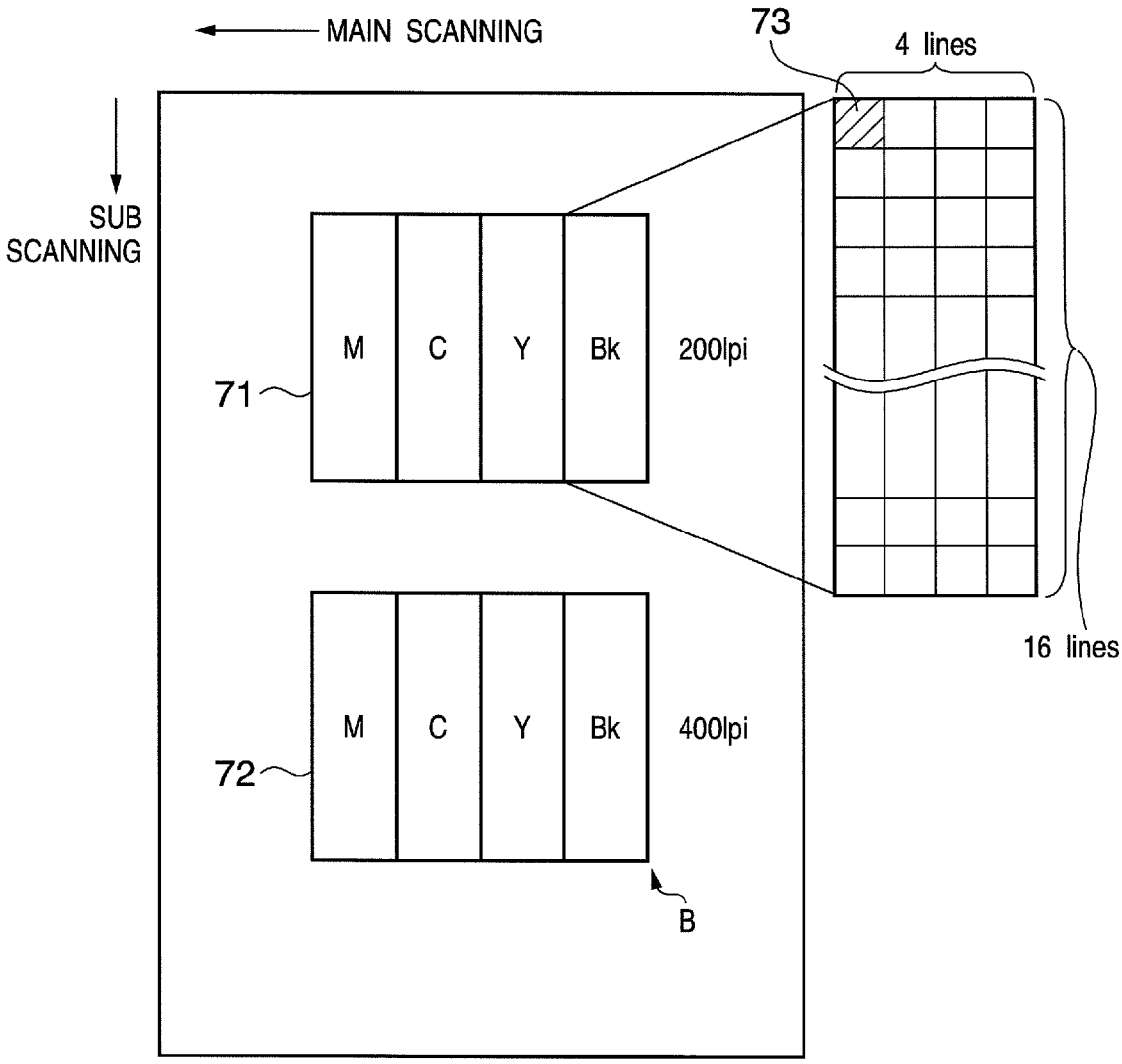
FIG. 12 is a view showing an example of test print 2.

In step S56 of FIG. 7, a print start button 150 of an image of test print 2 appears on the operation panel as shown in FIG. 10A. By pressing the print start button 150, the image of test print 2 in FIG. 12 is printed out. A message shown in FIG. 10B is displayed during printing.

FIG. 12 shows patches having gradation of a total of 64 gray levels for respective colors M, C, Y, and K in test print 2 of 4 columns and 16 rows. In this case, of the total of 256 gray levels, laser output levels corresponding to 64 gray levels are selectively assigned to a low-density region while thinned laser output levels are assigned to a high-density region. This makes it possible to appropriately modulate the tone characteristic especially at a highlight portion.

Referring to FIG. 12, reference numeral 71 denotes a patch having a resolution of 200 lpi (lines/inch); and 72, a patch having a resolution of 400 lpi (lines/inch). Forming images having the respective resolutions can be realized by preparing a plurality of triangular wave periods to be used in comparison with processing target image data in the pulse width modulation circuit 26.

The image forming apparatus in this embodiment generates a tone image and a line image such as a character with resolutions of 200 lpi and 400 lpi, respectively. The apparatus outputs patterns with two types of resolutions and the same tone level. However, if these images have largely different tone characteristics due to a difference in resolution, a previous tone level is preferably set in accordance with the resolution. Test print 2 can be generated by a pattern generator 29 without affecting the LUT 25.

Figure 14:
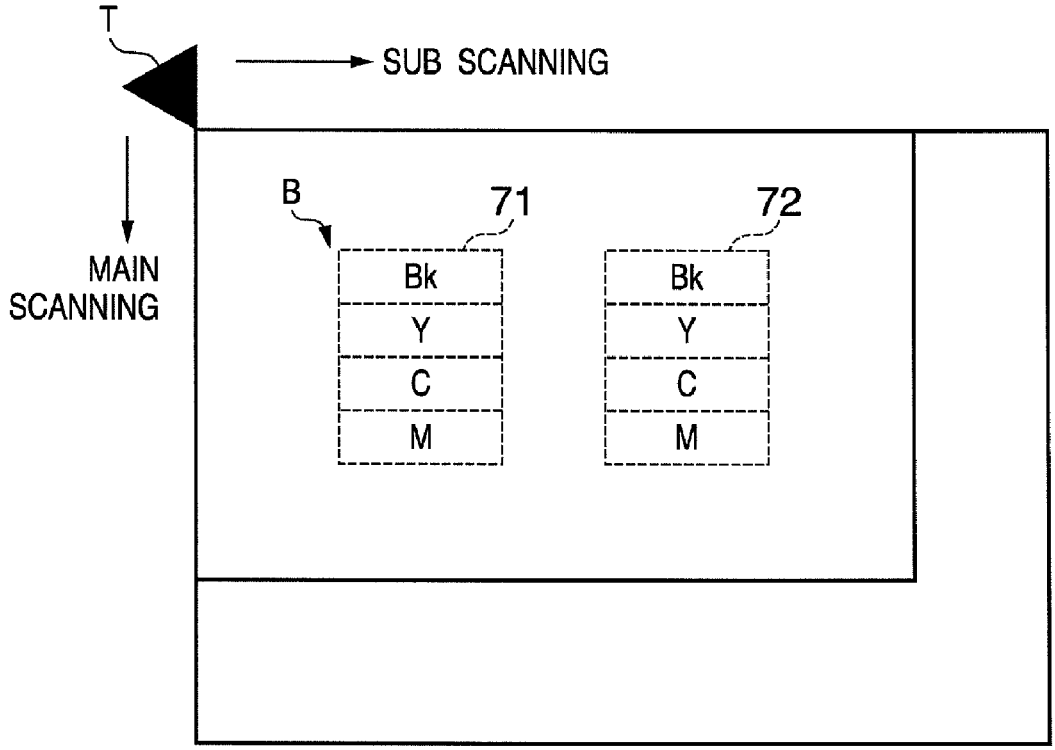
FIG. 14 is a view for explaining an operation for setting a result of test print 2 on the document table.

FIG. 14 is a schematic view when the document glass table 102 is seen from above upon placing the output of test print 2 thereon. An upper left wedge mark T is a document abutment mark on the document table. A message is displayed on the operation panel (FIG. 10C) so as to prompt the operator to bring a pattern Bk to the abutment mark T side and to avoid any confusion between the front and back sides. This makes it possible to prevent any errors due to misplacement.

To read the pattern using the reader unit A, it is gradually scanned from the abutment mark T in step S57. A first density gap point B can be obtained. The patch positions of the pattern are calculated by relative coordinates from these coordinate points to read the output of test print 2.

Figure 18:
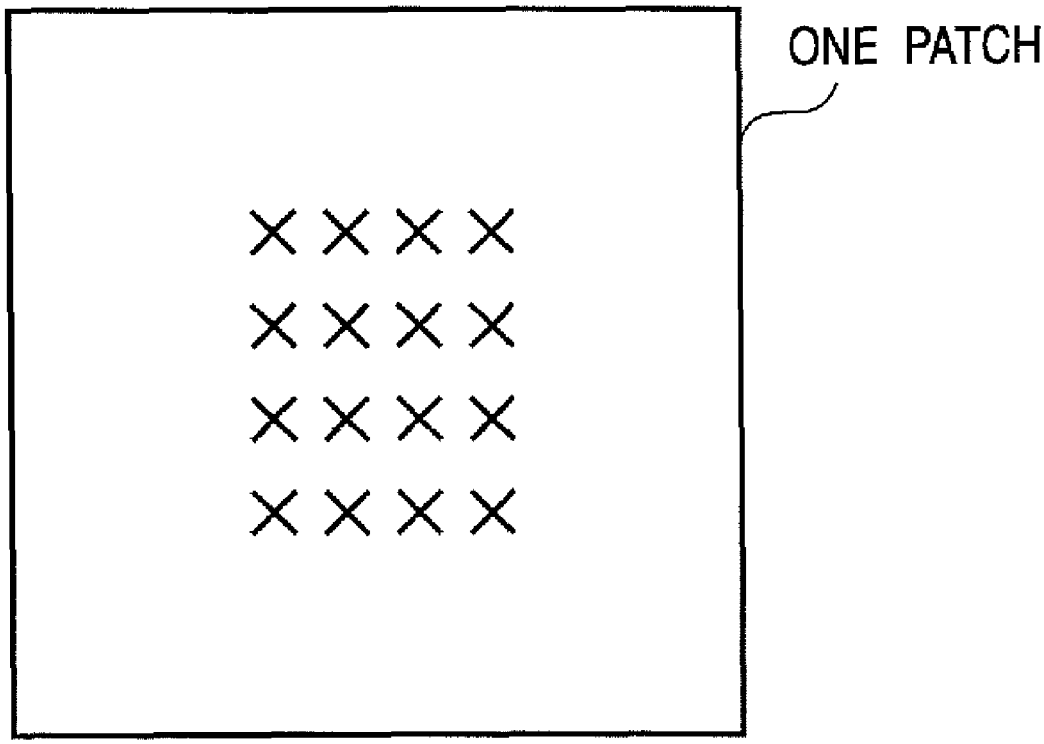
FIG. 18 is a view showing the reading points of a patch pattern.

FIG. 18 shows the reading points per unit patch (73 in FIG. 12). Sixteen reading points (x) within the patch are sampled to average the obtained signals. The number of points is preferably optimized by the reading device and image forming apparatus.

Figure 19:
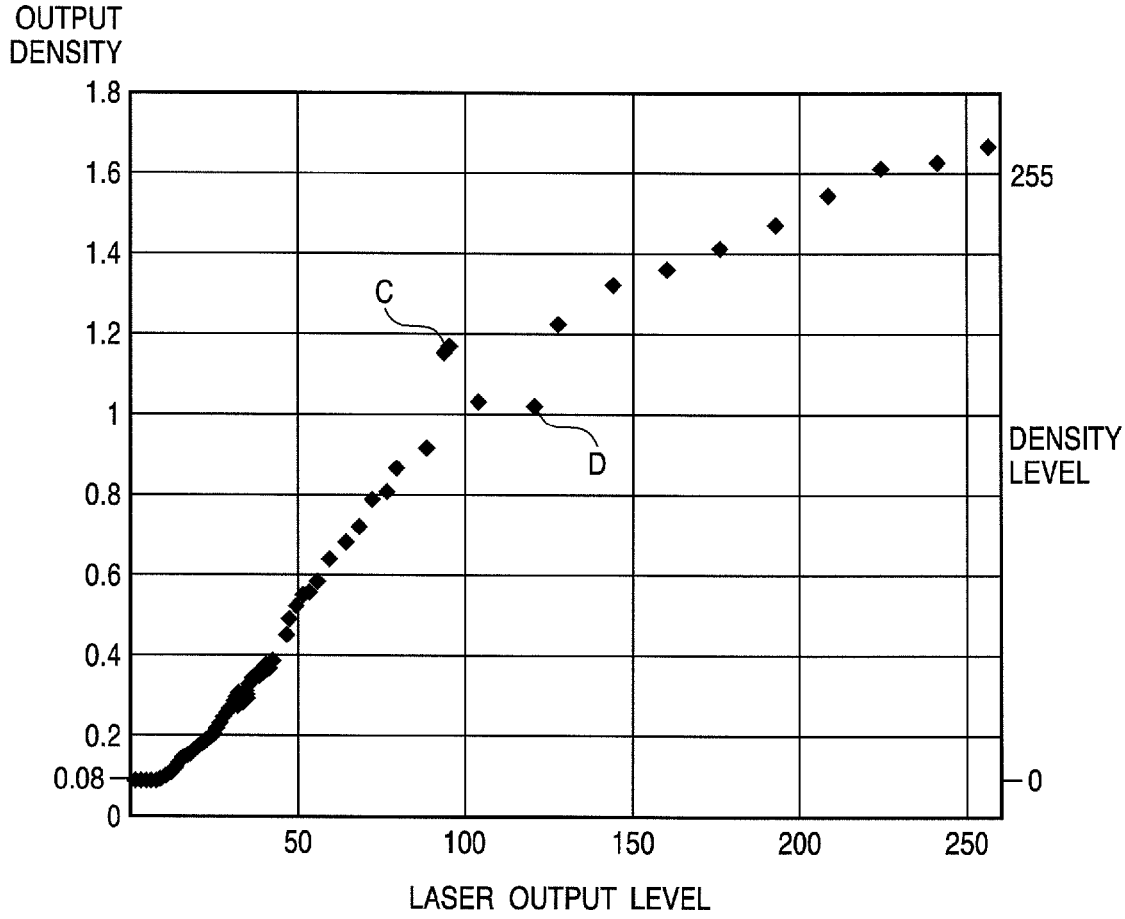
FIG. 19 is a graph showing the relationship between the laser output level and the output density and the relationship between the laser output level and the density level obtained by normalizing the output density.

FIG. 19 is a graph in which, when an RGB signal obtained by averaging the values of sixteen points for each patch is converted into a density value by the above-described method for conversion into the optical density, the thus obtained output density is plotted along the left ordinate and the laser output level is plotted along the abscissa.

Furthermore, the right ordinate in FIG. 19 represents the base density level. In this embodiment, 0.08 corresponding to the left ordinate is normalized to level 0, and 1.60 corresponding to the left ordinate that is set as the maximum density of this image forming apparatus is normalized to level 255.

If the obtained data exhibits distinctively high or low density as indicated by a point C or D, the document glass table 102 may have dirt thereon or the test pattern may have a defect thereon. To solve this problem, the slope is corrected under the control of a limiter so as to keep the continuity of a data string. More specifically, the slope is fixed to 3 if it takes 3 or more, and the slope is corrected to a density level equal to the previous level if it takes a negative value.

As described above, the contents of the LUT 25 can be easily created only by coordinate-transforming the density level and laser output level in FIG. 19 into the input level (the density signal axis in FIG. 6) and output level (the laser output signal axis in FIG. 6), respectively. The value of a density level that is not assigned to the patch is calculated by an interpolation operation. At this time, a limitation condition is set such that the output level becomes 0 relative to input level 0.

Referring back to the flowchart in FIG. 7, the transformation contents created as described above are set in the LUT 25 in step S58.

Figure 10D:
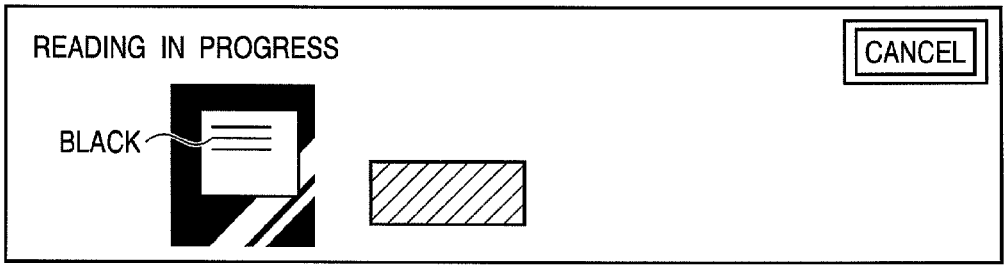
Figure 10E:
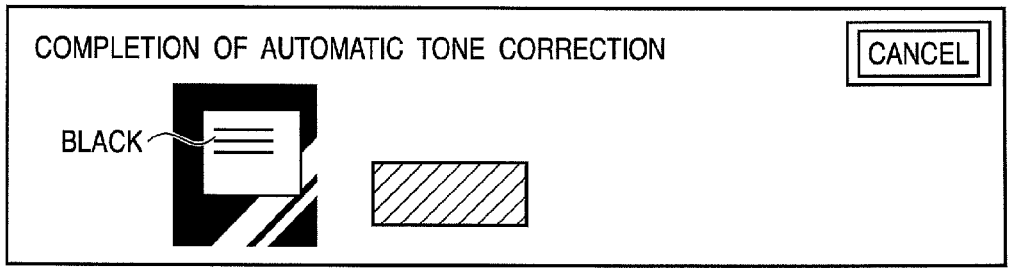

With the above processes, γ conversion table creation and contrast potential control by the first control system using the reading device are completed. During the above processes, a message shown in FIG. 10D is displayed. A message shown in FIG. 10E is displayed upon completion.

(Second Control System)

A second control system associated with stabilization of the image reproduction characteristic of the printer unit B alone will be described next as image control executed at the time of activation or during normal image formation. This control operation achieves image stabilization by detecting the density of the patch pattern on the photosensitive drum 4 and correcting the above-described LUT 25.

Figure 20:
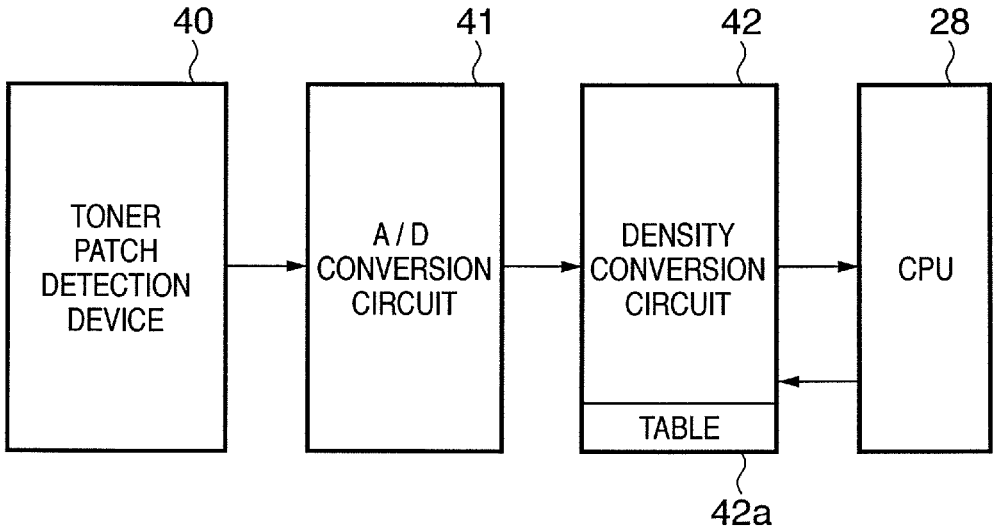
FIG. 20 is a block diagram showing the arrangement of a processing circuit to process a signal from a detection device 40 including an LED 10 and photodiode 11 relative to the photosensitive drum 4.

FIG. 20 is a block diagram showing the arrangement of a processing circuit to process a signal from the detection device 40 including the LED 10 and a photodiode 11 relative to the photosensitive drum 4. Near-infrared light which emerges from the photosensitive drum 4 and enters the detection device 40 is converted into an electrical signal by the detection device 40. Output voltages of 0 to 5 V of the electrical signal are converted into digital signals of levels 0 to 255 by an A/D conversion circuit 41. The obtained signals are then converted into densities by the density conversion circuit 42.

Figure 21:
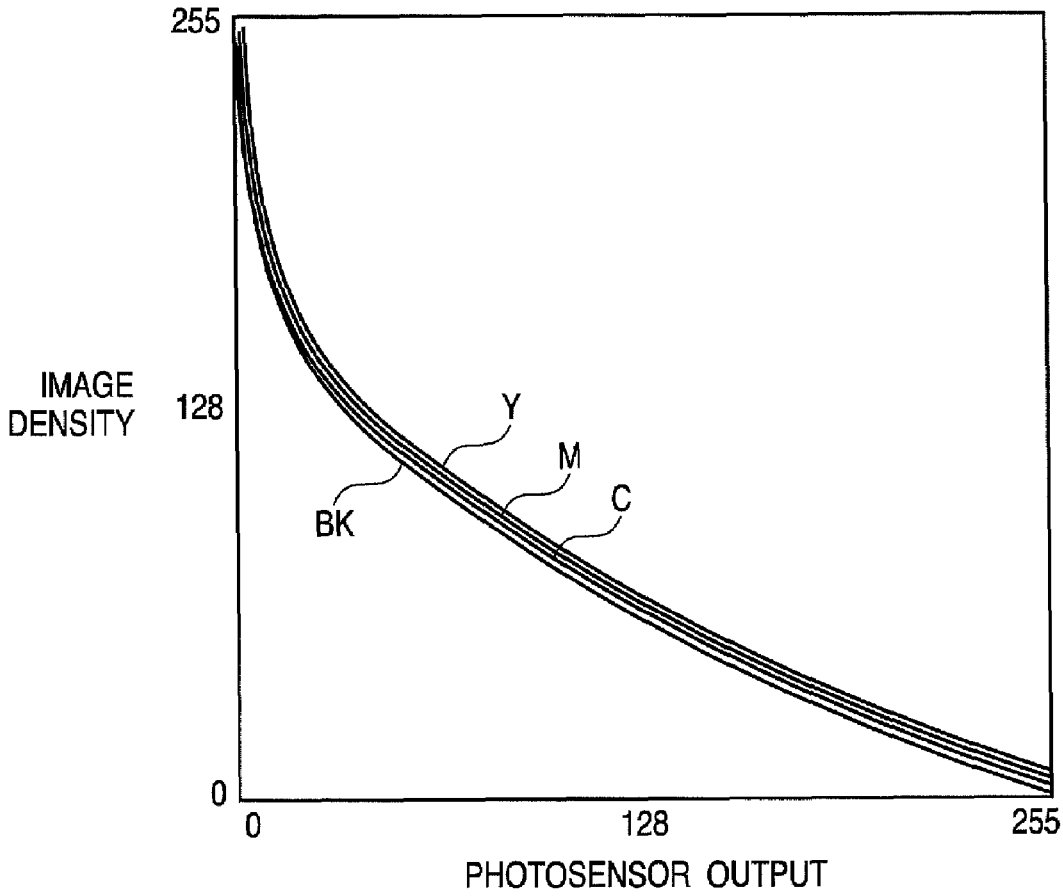
FIG. 21 is a graph showing the relationship between the photosensor output and the image density.

The detection device 40 used in this embodiment detects light regularly reflected by the photosensitive drum 4. FIG. 21 shows the relationship between the output image density and the output from the detection device 40 when the density of the pattern on the photosensitive drum 4 is gradually changed by area coverage modulation for respective colors. In this case, the output from the detection device 40 when no toner adheres to it is set to 5 V, i.e., level 255.

As is obvious from FIG. 21, as the image density and the area coverage ratio with toners increase, the output from the detection device 40 becomes smaller than when the photosensitive drum 4 has no toner. From this characteristic, preparing, for each color, a table 42*a* to convert a sensor output signal into a density signal makes it possible to accurately read density signals of all colors.

Figure 22:
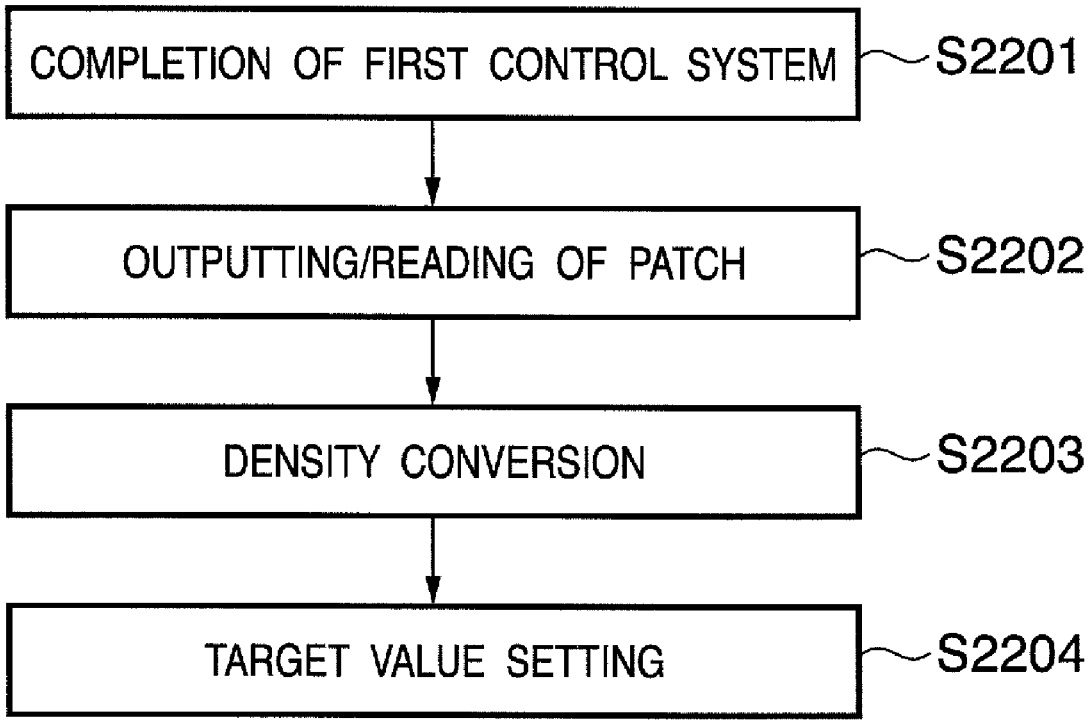
FIG. 22 is a flowchart for explaining the flow of a target value setting process.

The second control system aims at stable maintenance of color reproduction achieved by the first control system. Therefore, a state immediately after completing the control operation by the first control system is set as the target value. FIG. 22 shows the flow of a target value setting process. When the control operation by the first control system is completed (S2201), the patch patterns of respective colors M, C, Y, and K are formed on the photosensitive drum and detected by the detection device 40 (S2202). The patch laser output uses a density signal (the density signal axis in FIG. 6) of level 128 here regardless of the color. At this time, the contents of the LUT 25 and the setting of the contrast potential are the same as those obtained by the first control system (S2203). The density value 128 (specific level) on that occasion is set as the target value of the second control system (S2204) and backed up. The target value is updated every time the control operation by the first control system is performed.

The second control system controls to detect the density of a patch formed on the photosensitive drum 4 and to correct a γ LUT obtained by the first control system, as needed. It is important that the patch laser output matches with that obtained upon setting the target value. The patch laser output uses a density signal (the density signal axis in FIG. 6) of level 128 regardless of the color. At this time, the contents of the LUT 25 and the setting of the contrast potential are the same as those on that occasion in normal image formation. That is, the results obtained by correcting, by the second control system up to the preceding time, the settings obtained by the first control system are used.

The density signal 128 is controlled such that the patch output density becomes 128 with a density scale in which 1.6 is normalized to 255. However, the image characteristic of a printer is unstable, so there is a chance that it changes anytime. For this reason, a measurement result sometimes shifts by ΔD from 128. On the basis of the value ΔD, the second control system corrects the LUT 25 (γ LUT) created by the first control system.

Figure 23:
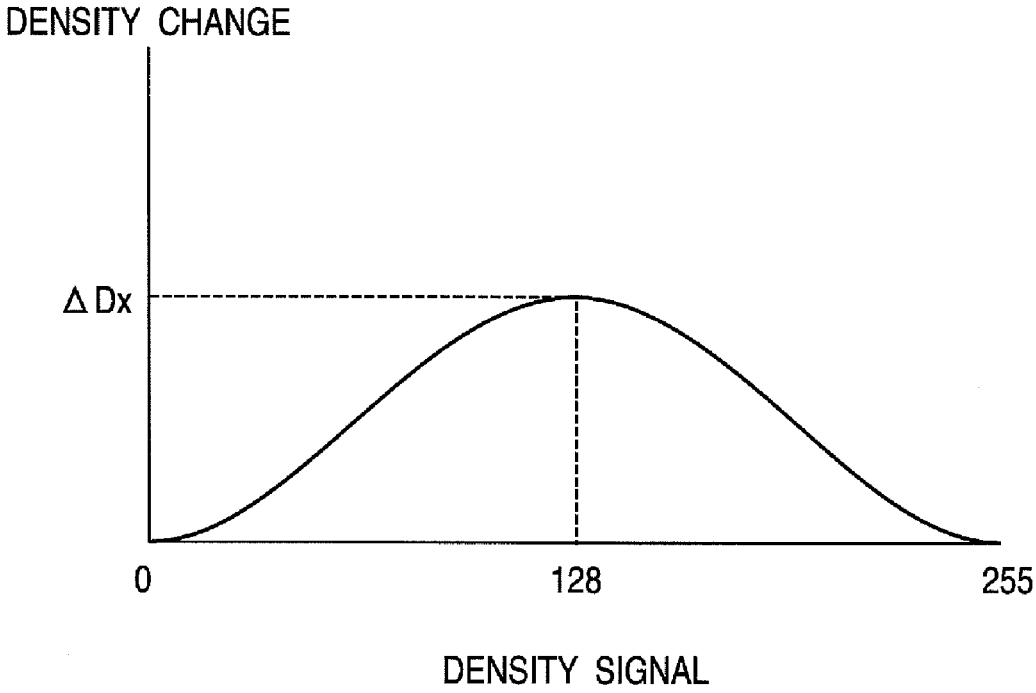
FIG. 23 is a graph showing the relationship between the output density change and the general density signals 0 to 255 when the output density in a density signal 128 has shifted by $\Delta D_x$.

FIG. 23 shows the relationship between the output density change and the general density signals 0 to 255 when the output density in the density signal 128 has shifted by $\Delta D_x$. This characteristic is given in advance. In the control operation, a γ LUT correction table is normalized such that the shift value at the density signal 128 becomes ΔT. An LUT that is so formed as to cancel the normalized γ correction table is added to the LUT 25, thereby correcting it. A timing at which the LUT 25 is rewritten changes depending on the color involved. When the LUT 25 is ready to be rewritten, it is rewritten in accordance with a TOP signal generated while the LUT 25 of the color of interest is not written by laser.

An image forming apparatus comprises an image forming unit for transferring toner images developed on the image carrier (photosensitive drum 4) onto a plurality of printing media (e.g., 6A and 68B in FIG. 26) on an intermediate transfer body (transfer drum 5) to form a plurality of toner images on the printing media. The image forming apparatus comprises a determination unit which determines whether a reserved print job exists at the time of activation, and an adjustment control unit which controls image adjustment execution in accordance with the determination result obtained by the determination unit.

Moreover, the image forming apparatus further comprises a correction unit which corrects the image formation condition on the basis of the toner density detected by the detection device 40 which detects the toner density of a toner image developed on the image carrier (photosensitive drum 4). The adjustment control unit can execute image adjustment in accordance with the image formation condition corrected by the correction unit.

The printer control unit 109 in the printer unit B can function as the above-described determination unit, adjustment control unit, and correction unit under the control of the CPU 214 and the CPU 28.

Figure 28A:
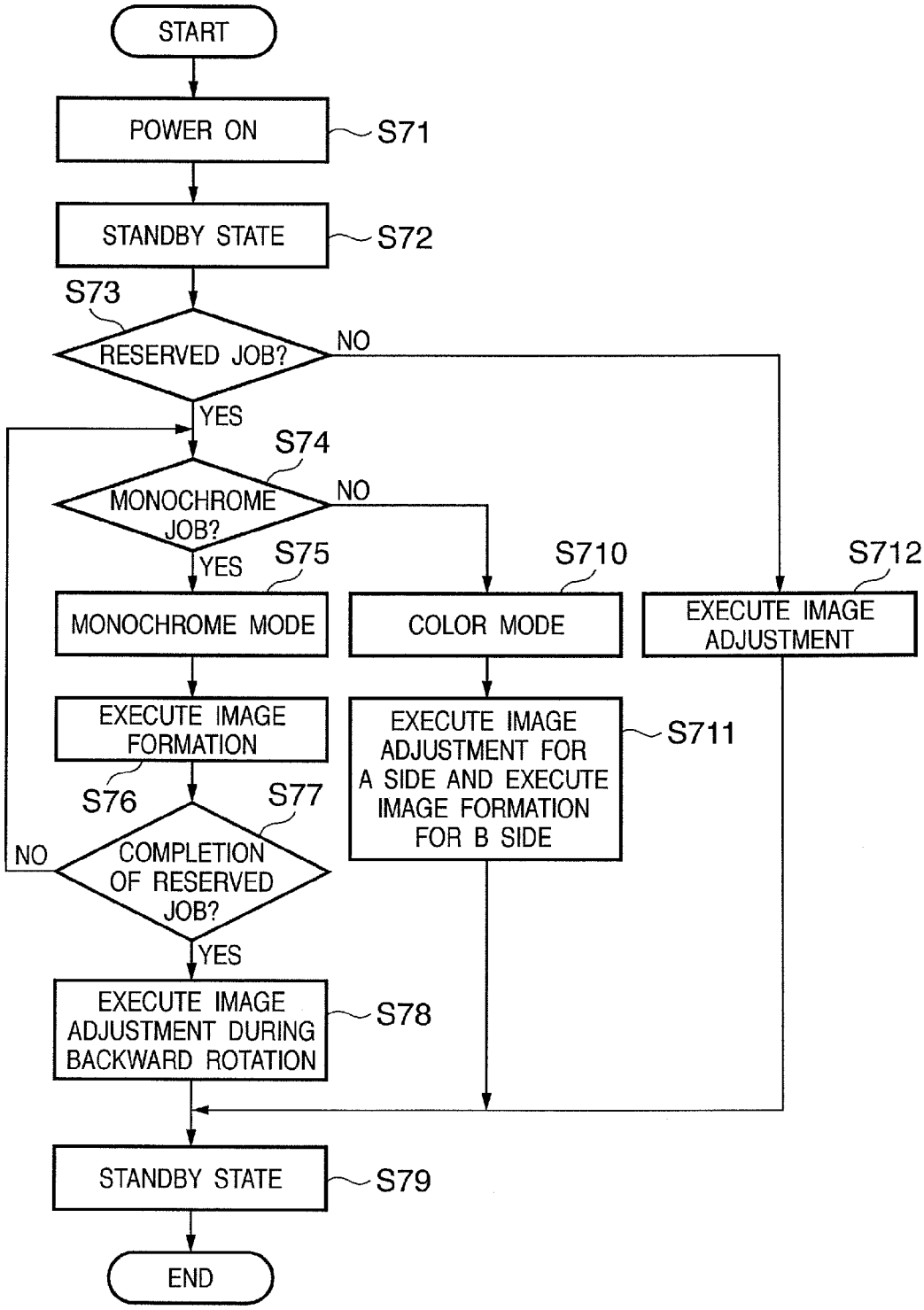
FIG. 28A is a flowchart for explaining the flow of an image adjustment timing control process according to the first embodiment.

FIG. 28A is a flowchart showing the flow of an image adjustment timing control process according to this embodiment. In the flowchart shown in FIG. 28A, the determination unit and adjustment control unit mainly proceed with the processes involved.

In step S71 of FIG. 28A, the image forming apparatus is powered on or returned from a low-power mode to a normal power supply mode. In step S72, temperature control of the fixing unit is completed and the apparatus shifts to a standby state. Up to here, image adjustment by the second control system is not executed.

It is determined in step S73 whether a reserved job already exists. If a reserved job already exists (S73—YES), the process advances to step S74.

It is determined in step S74 whether the reserved job is a monochrome print job (monochrome job) or color print job (color job). If the reserved job is a monochrome job (S74—YES), the process advances to step S75 to set a monochrome mode for processing a monochrome job. In step S76, an image is formed by a normal monochrome sequence.

It is determined in step S77 whether the reserved job is complete. If the reserved job is complete (S77—YES), the process advances to step S78. To prepare for the next print operation, the photosensitive drum 4 starts rotating backward under the control of the printer control unit 109. The characteristic feature of this embodiment resides in that the above-described image modulation operation by the second control system is executed simultaneously with backward rotation operation execution.

Figure 29:
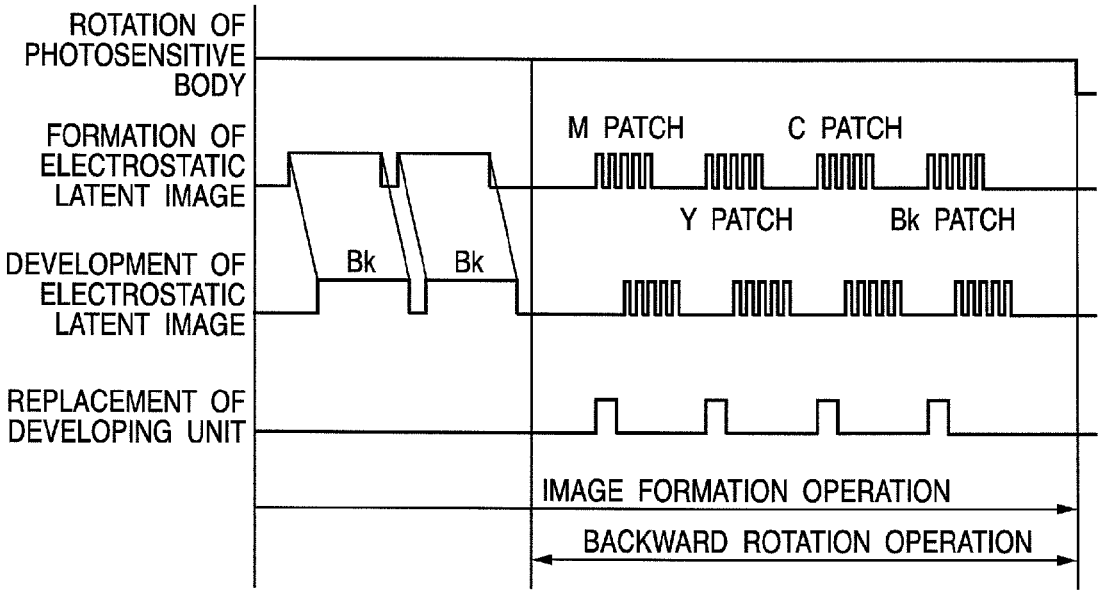
FIG. 29 is a timing chart showing the relationship in image formation sequence performed in backward rotation.

FIG. 29 is a timing chart showing the relationship in image formation sequence for executing the above-described image adjustment operation by the second control system in backward rotation. In backward rotation, an electrostatic latent image is formed with color toner on the photosensitive drum 4, and is developed to form images of patch patterns (M, Y, C, and Bk patches) of respective colors. These patch patterns are detected by the detection device 40 for respective colors so as to feed them back to the density correction circuit and γ correction circuit. The result is reflected on the image formation time subsequent to the next job (standby state (S79) in FIG. 28A). As compared with the prior arts, the wait time is shortened because image adjustment is executed after monochrome job formation instead of after a warm-up.

Referring back to the flowchart in FIG. 28A, if the reserved job further continues in step S77 (S77—NO), the process returns to step S74 to repeat the same routine.

If the reserved job is found to be a color job in step S74 (S74—NO), the process advances to step S710 to set a color mode for processing a color job. That is, if the reserved job is a color job which enables two-page printing (e.g., A4 or B5 size), a color mode is directly set. On the other hand, if the reserved color job is a color job which disables two-page printing (e.g., A3 or B5 size), the CPU 214 or 28 changes the magnification of an image of interest to that which allows to form the image of that color job with a size which enables two-page printing (e.g., from A3 size to A4 size/from B4 size to B5 size). First, the image is adjusted. Subsequently, the image whose magnification has changed is formed. Whether the reserved job enables or disables two-page printing and whether it is a color job may be determined on the basis of an image formation mode input from the operation unit 217. If the magnification of the size of the image from a color job which disables the two-page printing to a color job which enables the two-page printing is effectively changed from the activation until the standby state, the users great inconvenience is improved.

The process advances to step S711. In step S711, a color image is formed. The characteristic feature of this embodiment resides in that a color image is formed while executing image adjustment by the second control system.

Figure 26:
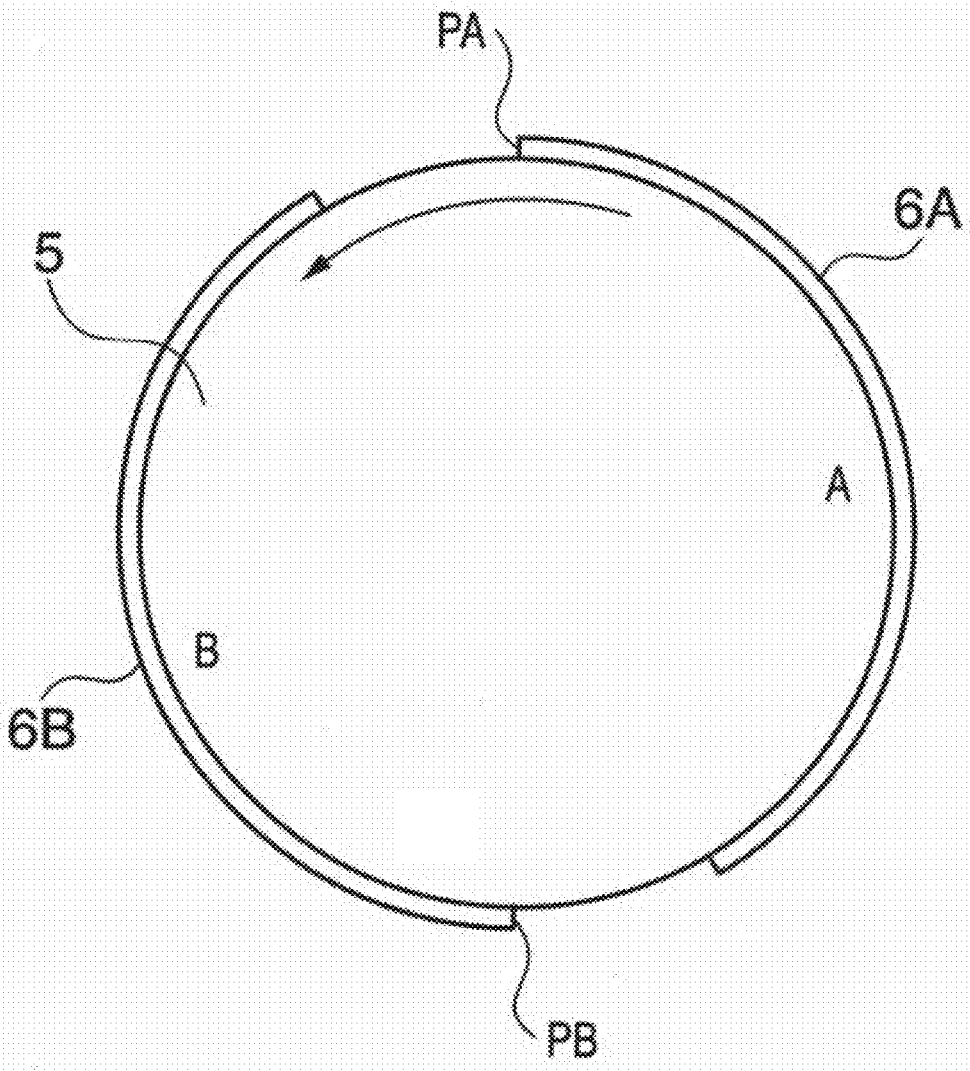
FIG. 26 (Prior Art)
FIG. 26 is a view showing a state in which two printing media 6A and 6B are simultaneously carried on the peripheral surface of a transfer drum.
Figure 30:
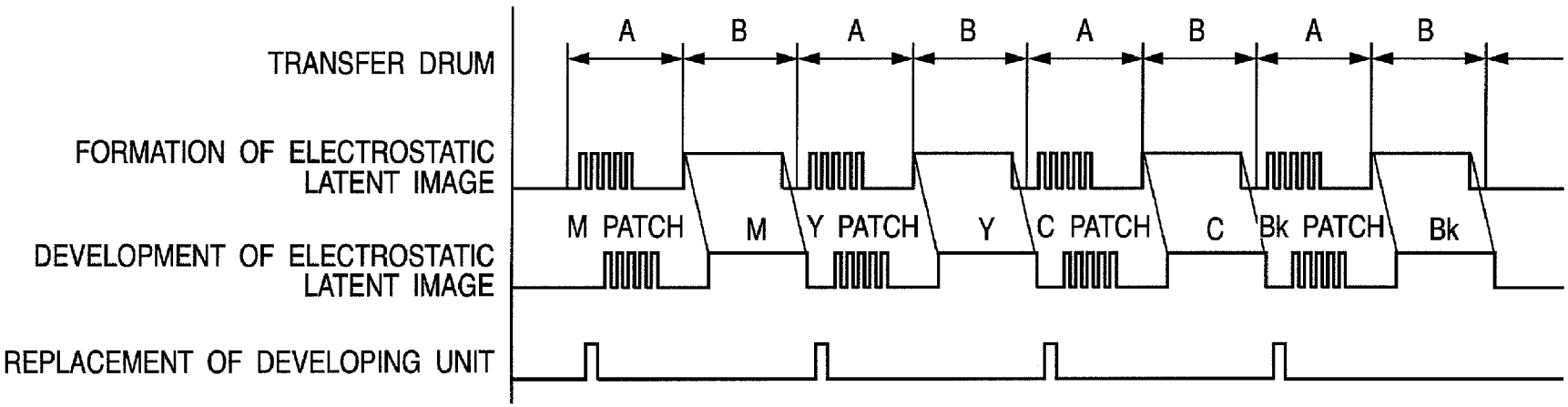
FIG. 30 is a timing chart showing the relationship in image formation sequence when an image formation operation is performed while executing image adjustment.

FIG. 30 is a timing chart showing the relationship in image formation sequence when an image formation operation is performed while executing image modulation. In the color image formation sequence, two-page printing that allows a plurality of printing media 6A and 6B (e.g., two A4 or B5-size sheets) to be simultaneously carried on the transfer drum 5 as shown in FIG. 26 is applied to practical use. In FIG. 26, at a timing corresponding to an image region (indicated by "A" in FIG. 30) of the printing medium 6A, an M-color patch pattern (M patch) is developed on the photosensitive drum 4. The obtained pattern is detected by the detection device 40 so as to feed it back from the detected density data to the density correction circuit and γ correction circuit. An M image formed in an image region (indicated by "B" in FIG. 30) of the printing medium 6B is adjusted. In this case, a region corresponding to the printing medium 6A on the transfer drum 5 does not carry a printing medium. The photosensitive drum 4 is cleaned so as to prevent the patch toner thereon from being transferred onto the transfer drum 5. After that, the printing medium is carried on only a region corresponding to the printing medium 6B to form the M image. The surface of the photosensitive drum 4 is cleaned of the toner. Similarly, Y, C, and Bk patches and Y, C, Bk images undergo the image adjustment and image formation operations. In case of FIG. 31 (to be described later), an M patch is formed on a surface (from a reference position 51A to a reference position 51B) corresponding to the reference position 51A of an intermediate transfer belt 51 (indicated by "A" in FIG. 30). The obtained pattern is detected by the detection device 40 so as to feed it back from the detected density data to the density correction circuit and γ correction circuit. An M image formed on a surface (from the reference position 51B to the reference position 51A) corresponding to the reference position 51B of the intermediate transfer belt 51 (indicated by "B" in FIG. 30) is adjusted. In this case, a printing medium is not conveyed to the surface corresponding to the reference position 51A of the intermediate transfer belt 51 so as to control to prevent the patch toner on the intermediate transfer body 51 from being transferred onto the printing medium. The printing medium is conveyed to the surface corresponding to the reference position 51B so as to control to transfer the M image on the intermediate transfer belt 51 onto the printing medium. After that, the surface of the intermediate transfer belt 51 is cleaned of the toner. Similarly, Y, C, and Bk patches and Y, C, Bk images undergo the image adjustment and image formation operations.

In the above embodiment, image adjustment is executed by forming M, Y, C, and Bk patches of corresponding colors one by one in respective A regions. However, a plurality of M patches having density gradients may be formed in respective A regions. The same may apply to types that allow to form pluralities of Y, C, and Bk patches having density gradients.

If the reserved job is a color print job which enables two-page printing by performing the above-described image formation sequence in step S74 (S74—NO), the color mode which enables two-page printing is set, simple image adjustment by the second control system is executed simultaneously with image formation operation execution. By the result, to shorten the wait time becomes possible. This makes it possible to provide a modulated full-color image even by a color job reserved in the first place after activation.

If no reserved job exists in step S73 (S73—NO), the process advances to step S712 to execute image adjustment by the second control system after a warm-up.

As has been described above, according to this embodiment, an image formation operation is performed while executing image adjustment upon omitting image adjustment after completion of a warm-up operation at the time of activation, and selecting an image adjustment mode in the subsequent process depending on the presence/absence of a reserved job and whether the reserved job is a monochrome print job or color print job. As a result, in particular, if a reserved job is a color print job, a color mode which enables two-page printing can be set to shorten the wait time and output an adjusted image.

Second Embodiment

Image adjustment only by a printer unit B at the time of activation includes maximum density correction for keeping the toner of each color at a maximum density and tone correction for keeping the halftone characteristic linear with respect to the input image signal. The above-described simple type second control system will be described next as image adjustment executed only by the printer unit B during normal image formation.

Maximum density correction and tone correction are applications of automatic tone correction which has been described in the first control system and is executed by a mode setting button at the time of activation. These corrections are conducted in the printer without using a scanner. That is, this control system stabilizes the maximum density by causing the detection device 40 to read a patch pattern formed on an image carrier and controlling its contrast potential, and stabilizes the tone linearity by correcting a lookup table for output tone correction execution. This control system achieves accurate adjustment even though it requires a longer adjustment time than in the above-described second control system.

Figure 28B:
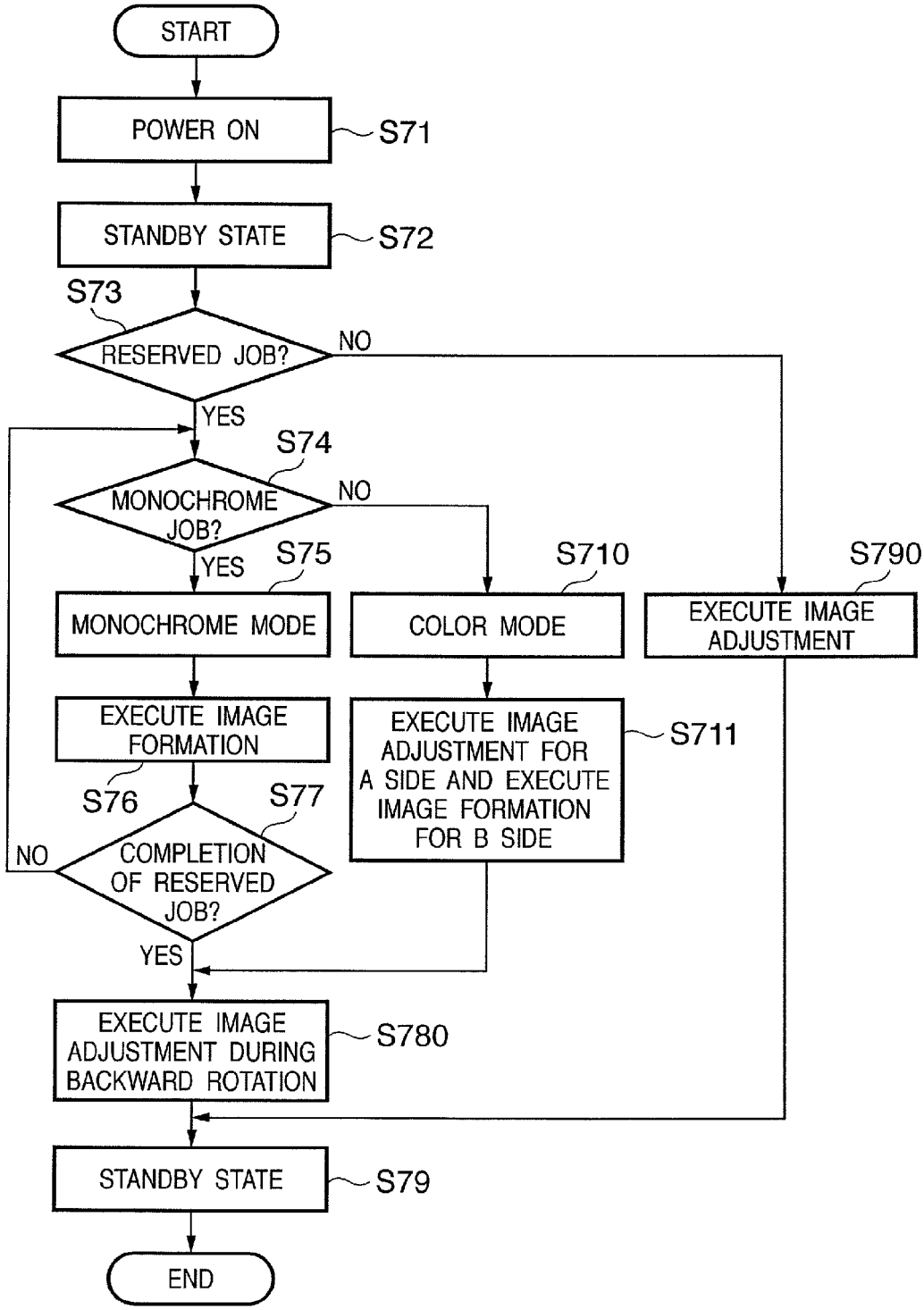
FIG. 28B is a flowchart for explaining the flow of an image adjustment timing control process according to the second embodiment.

Moreover, the above-described second control system is adopted as image control during normal image formation. Image adjustment timing control according to this embodiment follows the flowchart in FIG. 28B. In FIG. 28B, different contents to FIG. 28A are explained hereafter.

It is determined in step S77 whether a reserved job is complete. If the reserved job is complete (S77—YES), the process advances to step S780. To prepare for the next print operation, a photosensitive drum 4 starts rotating backward under the control of a printer control unit 109. In this embodiment, maximum density correction and tone correction described above are executed during the backward rotation operation. If the reserved job is found to be a color job in step S74 (S74—NO), the process advances to step S710 to set a color mode which enables two-page printing. The process advances to step S711.

In step S711, a color image is formed. In this embodiment, a color image is formed while executing image adjustment by the second control system. After that, the process advances to step S780 to execute maximum density correction and tone correction described above during the backward rotation operation.

If no reserved job exists in step S73 (S73—NO), the process advances to step S790 to execute maximum density correction and tone correction described above after a warm-up.

If the reserved job is a color job by executing the above-described image formation sequence (S74—NO), the color mode which enables two-page printing is set, simple image adjustment by the second control system is executed simultaneously with image formation operation execution. By the result, to shorten the wait time becomes possible. This makes it possible to provide an adjusted full-color image even by a color job reserved in the first place after activation. Moreover, since maximum density correction and toner correction are executed after full-color image formation, stable image adjustment can be attained. This makes it possible to reflect the result on image formation subsequent to the next job.

Third Embodiment

Figure 31:
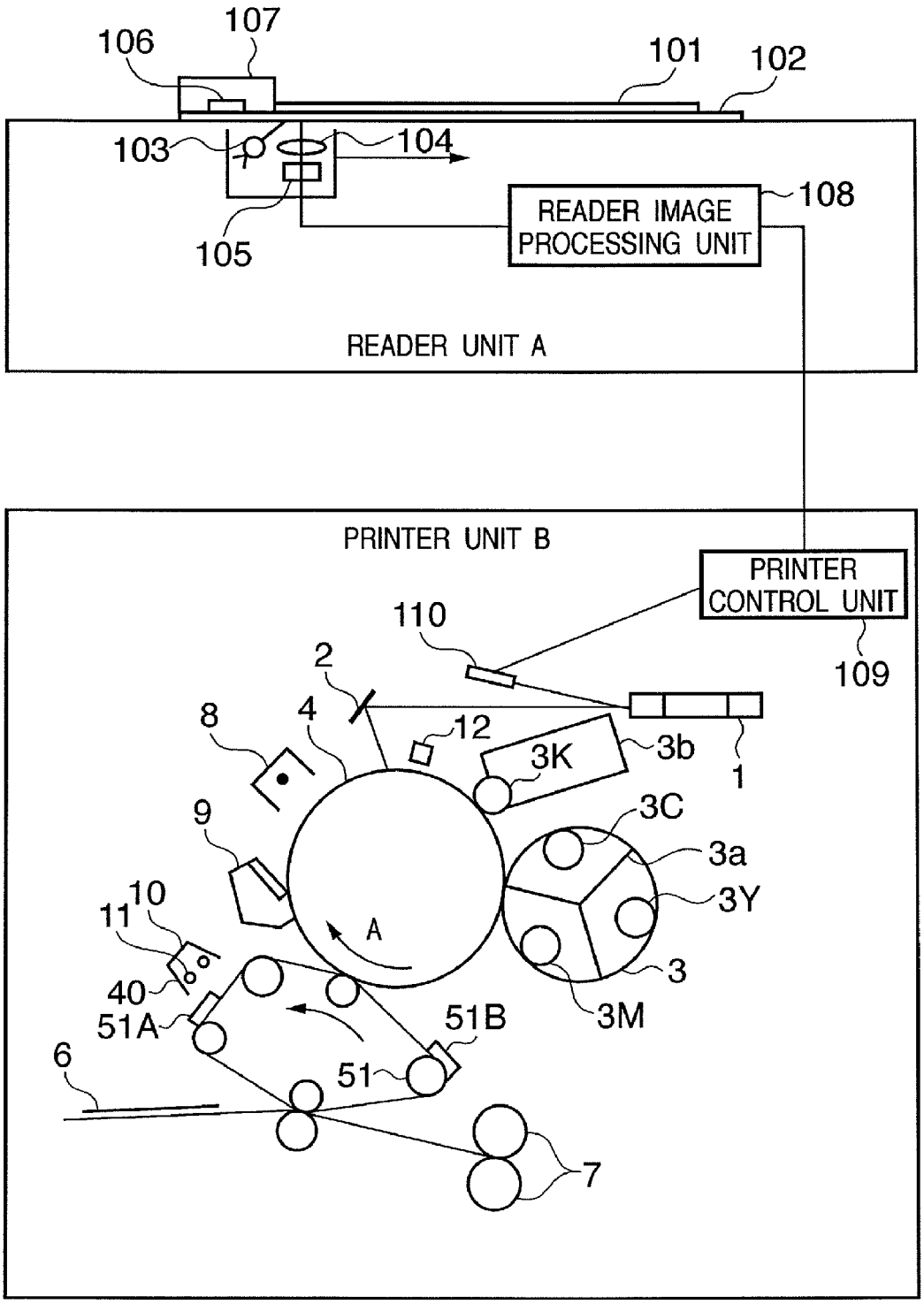
FIG. 31 is a sectional view showing the structure of an image forming apparatus according to the third embodiment of the present invention.

This embodiment exemplifies a case wherein the image adjustment timing is controlled for an image forming apparatus which forms an image using an intermediate transfer belt. FIG. 31 is a sectional view showing the structure of an image forming apparatus according to the third embodiment of the present invention. For image adjustment according to this embodiment, the detection device 40 is arranged on an intermediate transfer belt 51 to detect the density of patch toner. The image forming apparatus comprises a black developing unit 3*b* and a rotary developing unit 3*a* which accommodates magenta, cyan, and yellow toner developing units 3M, 3C, and 3Y. An arrangement in which these developing units execute development at the development position is the same as that in the first embodiment.

Toner images formed on a photosensitive drum 4 in accordance with image information of respective colors are in turn transferred onto the intermediate transfer belt 51. In a full-color mode, four color toners are transferred onto the intermediate transfer belt 51. After that, these toners are transferred at once onto a printing medium 6 fed from a paper feed unit. The obtained medium undergoes a fixing process by a fixing unit 7 and is discharged outside, thus forming a full-color print image.

In the arrangement shown in the first embodiment, a toner patch used for image modulation is formed on the photosensitive drum 4. However, this arrangement is not very preferable from the viewpoint of long-term stability because the toner patch reading performance remarkably varies when the surface of the photosensitive drum 4 deteriorates due to erosion or flaws over time.

To solve the problem, while the basic arrangement of this embodiment is the same as that of the first embodiment, its characteristic feature resides in that the detection device 40 is arranged on the intermediate transfer belt 51 which deteriorates less than the photosensitive drum 4 and so attains further stability.

An image forming apparatus comprises an image forming means for transferring toner images developed on an image carrier (photosensitive drum 4) onto a plurality of image formation positions corresponding to reference positions 51A and 51B on an intermediate transfer body (intermediate transfer belt 51) to form toner images on a plurality of printing media. The image forming apparatus further comprises a determination unit which determines whether a reserved print job exists at the time of activation, and a adjustment control unit which controls image adjustment execution in accordance with the determination result obtained by the determination unit.

The image forming apparatus further comprises a correction unit which corrects the image formation condition on the basis of the toner density detected by the detection device 40 which detects the toner density of a toner image transferred onto the intermediate transfer belt 51. The adjustment control unit can execute image adjustment in accordance with the image formation condition corrected by the correction unit.

A printer control unit 109 in a printer unit B can function as the above-described determination unit, adjustment control unit, and correction unit under the control of a CPU 28.

Image adjustment timing control according to this embodiment is executed by the same sequence as that shown in FIG. 28A, like in the first embodiment. Alternatively, this control is executed by the same sequence as that shown in FIG. 28, like in the second embodiment.

If it is determined by the determination unit that a reserved print job exists (S73—YES), the adjustment control unit determines whether the reserved print job is a monochrome job or color job (S74). The adjustment control unit controls image adjustment execution in accordance with the determination result.

If the adjustment control unit determines that the reserved print job is a monochrome job (S74—YES, S75), it causes the image forming device to form an image of the print job without executing any image adjustment (S76).

If the adjustment control unit determines that the reserved print job is a monochrome job (S74—YES, S75), it executes image adjustment during a backward rotation operation after the print job (S78 in FIG. 28A or S780 in FIG. 28B).

If the adjustment control unit determines that the reserved print job is a color job, it sets a color mode which enables two-page printing (S74—NO, S710). The adjustment control unit executes image adjustment in a first region corresponding to the reference position 51A on the intermediate transfer belt 51 (S711).

If the adjustment control unit determines that the reserved print job is a color job, it sets a color mode which enables two-page printing (S74—NO, S710). On the basis of the result of image adjustment executed in the first region, the adjustment control unit adjusts an image to be formed. In a second region corresponding to the reference position 51B on the intermediate transfer belt 51, the image forming device forms a toner image to be transferred onto a printing medium (S711 in FIG. 28A). In this case, the convey intervals of printing media are determined such that they are conveyed to the second region but are not conveyed to the first region.

In this embodiment, a toner patch is read on the intermediate transfer belt 51. However, the present invention is applicable to any arrangement which includes the detection device 40 having the same arrangement to read a toner patch for a transfer drum 5 or a transfer belt which conveys the printing medium 6. For example, although the reflection type sensor is provided in this embodiment, the present invention is naturally applicable to an arrangement constituted by a transmitting sensor as long as the transfer drum 5 or transfer belt is made of a material having a high transmittance. In the above description, a system has one drum. However, the present invention is also applicable to a system which has drums for four colors and transfers images onto an intermediate transfer belt, thereby transferring the images onto a recording medium. Alternatively, the present invention is applicable to a system which has drums for four colors to transfer images onto a printing medium on a transfer belt.

As has been described above, according to this embodiment, an image formation operation is performed while executing image adjustment upon omitting image adjustment after completion of a warm-up operation at the time of activation, and selecting an image adjustment mode in the subsequent process depending on the presence/absence of a reserved job and whether the reserved job is a monochrome print job or color print job. As a result, it is possible to shorten the wait time and output an adjusted image. In particular, if a reserved job is a color print job, a color mode which enables two-page printing can be set to shorten the wait time and output an adjusted image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2005-213376 filed on Jul. 22, 2005, which is hereby incorporated by reference herein.

What is claimed is:

1. An image forming apparatus comprising:

an image forming device which forms images on an image carrier, forms the images on an intermediate transfer body including a first region and a second region as regions to form the images, and forms the images of a plurality of colors on a printing medium; and a controller which, when an input image formation mode is found to be a color image formation mode by determining whether the input image formation mode is the color image formation mode, controls said image forming device to execute an image adjustment operation for adjusting an image formation condition of said image forming device by forming a patch image in the first region of the intermediate transfer body and to execute an operation for forming the image other than the patch image in the second region of the intermediate transfer body based on a result of the image adjustment operation obtained from the patch image formed in the first region of the intermediate transfer body, wherein if the input image formation mode is a color image formation mode for forming the image so as to spread over the first region and second region of the intermediate transfer body, said controller sets a multiple-page printing color image formation mode for forming the images in the respective first and second regions of the intermediate transfer body upon changing a magnification of the image to be formed while spreading over the first region and the second region of the intermediate transfer body to a magnification which allows the image to be formed in the second region of the intermediate transfer body.

2. The apparatus according to claim 1, further comprising a detection device which detects a density of a pattern image to be formed for the image adjustment, wherein said controller adjusts the image formation condition on the basis of an output from said detection device.

3. The apparatus according to claim 2, wherein said controller controls said image forming device to form the pattern image in the first region of the intermediate transfer body and to form the image in the second region of the intermediate transfer body on the basis of the adjusted image formation condition.

4. An image forming method executed by an image forming apparatus, said method comprising:

a step of image forming executed by an image forming device which forms images on an image carrier, forms the images on an intermediate transfer body including a first region and second region as regions to form the images, and forms the images of a plurality of colors on a printing medium; and a step of controlling executed by a controller which, when an input image formation mode is found to be a color image formation mode by determining whether the input image formation mode is the color image formation mode, controls said image forming device to execute an image adjustment operation for adjusting an image formation condition of said image forming device by forming a patch image in the first region of the intermediate transfer body and to execute an operation for forming the image other than the patch image in the second region of the intermediate transfer body based on a result of the image adjustment operation obtained from the patch image formed in the first region of the intermediate transfer body, wherein if the input image formation mode is a color image formation mode for forming the image so as to spread over the first region and second region of the intermediate transfer body, said controlling step sets a multiple-page printing color image formation mode for forming the images in the respective first and second regions of the intermediate transfer body upon changing a magnification of the image to be formed while spreading over the first region and the second region of the intermediate transfer body to a magnification which allows the image to be formed in the second region of the intermediate transfer body.

* * * * *